US007166398B2

(12) United States Patent
Itami et al.

(10) Patent No.: US 7,166,398 B2
(45) Date of Patent: Jan. 23, 2007

(54) ELECTROPHOTOGRAPHIC PHOTORECEPTOR AND DEVICE

(75) Inventors: Akihiko Itami, Hachioji (JP); Tomoo Sakimura, Hachioji (JP); Kazuhisa Shida, Hachioji (JP); Masao Asano, Hachioji (JP); Hiroshi Yamazaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 337 days.

(21) Appl. No.: 10/798,055

(22) Filed: Mar. 11, 2004

(65) Prior Publication Data

US 2004/0259009 A1 Dec. 23, 2004

(30) Foreign Application Priority Data

Jun. 20, 2003 (JP) ..... 2003-176185
Jun. 24, 2003 (JP) ..... 2003-179458
Jun. 24, 2003 (JP) ..... 2003-179459

(51) Int. Cl.
*G03G 5/14* (2006.01)

(52) U.S. Cl. ..... 430/60; 430/64; 430/65; 399/159

(58) Field of Classification Search ..... 430/60, 430/64, 65; 399/159
See application file for complete search history.

(56) References Cited

U.S. PATENT DOCUMENTS 4,804,606 A * 2/1989 Ohno et al. ..... 430/57.5
5,744,271 A * 4/1998 Aizawa et al. ..... 430/59.6
2001/0044063 A1* 11/2001 Hamaguchi et al. ..... 430/63

* cited by examiner

*Primary Examiner*—Mark A. Chapman
(74) *Attorney, Agent, or Firm*—Lucas & Mercanti, LLP

(57) ABSTRACT

An electrophotographic photoreceptor having an interlayer and a photosensitive layer on an electroconductive substrate, wherein the interlayer comprises any one of 1) an N-type semiconductive particle containing at least one of transition metals having an atomic number of 21 to 30, 39, 41 to 48 and 57 to 80, the total amount of the transition metals having an atomic number of 21 to 30, 39, 41 to 48 and 57 to 80 being from 100 ppm to 2.0% by mass, or 2) a metal oxide particle containing a silicon atom in a bond energy spectrum by the X-ray photoelectron spectroscopy at a ratio represented by the following Formula (1): Formula (1) $0.02 \leqq Si/M \leqq 0.55$ Si: a peak intensity of a silicon atom among the bond energy spectrum, and M: a peak intensity of a metal atom among the bond energy spectrum.

26 Claims, 1 Drawing Sheet

ELECTROPHOTOGRAPHIC PHOTORECEPTOR AND DEVICE

BACKGROUND

1. Technical Field

The present invention relates to an electrophotographic photoreceptor used in a field of copying machines or printers, and a device using the electrophotographic photoreceptor.

2. Description of Related Art

Because an electrophotographic photoreceptor (hereinafter, simply referred to as a photoreceptor) is greatly advantageous in that the selection range of materials is wide, the environmental suitability is excellent, the production cost is low, etc., as compared with an inorganic photoreceptor such as a selenium photoreceptor or an amorphous silicon photoreceptor, recently, the main stream of the electrophotographic photoreceptors is shifted to organic photoreceptors in place of inorganic photoreceptors.

On the other hand, in recent electrophotographic image forming methods, a digital image forming method using LED or laser as an image exposure light source is rapidly spread for a hard copy printer of personal computer or an usual copying machine due to ease of image processing as well as ease of expansion to a complex copying machine, and a technique for forming an electrophotographic image having high image quality by a digital system has been developed. For example, there is disclosed a technique in which image exposure is carried out using a laser beam having a small spot area, the density of a dotted latent image is increased to form a latent image with high precision, and the latent image is developed by a toner having a small particle diameter to thereby form an electrophotographic image having high image quality (JP Tokukai 2001-255685A).

Furthermore, down sizing and speed-up of recent electrophotographic apparatuses such as digital copying machines and printers have been progressed, and both of high sensitivity corresponding to a high speed tendency and a long life by improvement in abrasion resistance have been demanded as photoreceptor properties.

In order to meet the above-described requirements for high image quality, down sizing and high speed tendency, organic photoreceptors must have adaptability to reversal development most suitable for the development of digital latent images as well as charging property and electrophotographic properties such as high sensitivity and low dark decay.

In order to meet the above-described requirements for high image quality, down sizing and high speed tendency, time response properties of sensitivity of the photoreceptor must be elevated. In order to meet these requirements, organic photoreceptors are designed to have a layer construction where the photosensitive layer is functionally separated into a charge generation layer and a charge transportation layer, and thereby, pursuing high sensitivity and a high-speed property of the charge generation layer and the charge transportation layer.

However, when these charge generation materials or charge transportation materials having high sensitivity and a high-speed property are used, there arises a problem that stability in charging property or sensitivity is easily deteriorated. Specifically, there arises a problem that charging potential is liable to decrease or residual potential is liable to increase under a high temperature and high humidity environment or a low temperature and low humidity environment.

More specifically, when the stability in the charging potential or the sensitivity is deteriorated, a difference between the potential at the unexposed portion (VH) and the potential at the exposed portion (VL) on the photoreceptor is reduced to result in decrease in image density and at the same time, a potential difference between the potential at the unexposed portion (VH) and the direct current bias potential (VDC) applied between the photoreceptor and the developing sleeve is also reduced to result in easy occurrence of image defects such as black spots, in the reversal developing process.

In order to solve the above-described problems in the stability of charging potential and the image defects such as black spots, a technique of using an interlayer in the organic photoreceptor is developed. For example, there is known an organic photoreceptor having a construction where an interlayer comprising a resin and a titanium oxide particle dispersed in the resin is provided between an electroconductive substrate and a photosensitive layer. Further, a technique of using an interlayer comprising a surface-treated titanium oxide is also known. For example, there is proposed a organic photoreceptor having an interlayer using titanium oxide surface-treated by iron oxide or tungsten oxide (for example, JP Tokukaihei 4-303846A), titanium oxide surface-treated by an amino group-containing coupling agent (for example, JP Tokukaihei-9-96916A), titanium oxide surface-treated by an organosilicon compound (for example, JP Tokukaihei-9-258469A), titanium oxide surface-treated by a methylhydrogenpolysiloxane (for example, JP Tokukaihei-8-328283A), or branch-shaped titanium oxide surface-treated by a metal oxide or an organic compound (for example, JP Tokukaihei-11-344826A).

However, even when these foregoing techniques are applied, formation of black spots cannot be sufficiently prevented under serious environments such as a high temperature and high humidity. Moreover, there arise problems such that a sufficient image density cannot be obtained as a result of increase in the residual potential and the potential at the exposed portion accompanied with repetition of the use.

Further, it has been proposed to control more accurately the crystalline structure of titanium oxide and to improve the above-described problems such as formation of black spots or increase in the residual potential and the potential at the exposed portion accompanied with repetition of the use. For example, an interlayer comprising an anatase-type titanium oxide pigment (hereinafter referred to also as an anatase-type titanium oxide or an anatase-type titanium oxide particle) has been proposed (for example, JP Tokukaihei-11-327188A). The anatase-type titanium oxide has a low volume resistivity as compared with rutile-type titaniumu oxide and therefore, the interlayer can be formed in a large film thickness. By covering irregularity on the electroconductive support with the thickness, the injection of charges from the electroconductive support is easily blocked, on the contrary, an increase of fog in the reversal development is liable to be caused as a result of increase in dark decay of charging potential. In this Patent Document, sufficient solutions to such opposed problems cannot be found yet.

In addition, a method of forming an interlayer by dispersing the above-described titanium oxide particle, etc. in a polyamide resin is widely known. However, a copolymer polyamide resin or a methoxymethylated polyamide resin, which is usually used as a polyamide resin in this case and composed of a chemical structure having a small number of carbon chains between amide bonds, such as 6-nylon is high in a water absorption coefficient. Therefore, the interlayer formed by using such a polyamide has a tendency to be increased in the environmental dependency, as a result, formation of black spots, etc. easily occurs due to increase in the residual potential accompanied with repetition of the use or easy change in charging property under high temperature and high humidity conditions.

A copolymer polyamide resin comprising a constituent element having a large number of carbon chains between amide bonds, such as 12-nylon resin is low in a water absorption coefficient. Therefore, it is expected that the resin is a useful material for producing a photoreceptor having low environmental dependency. However, such a polyamide is insoluble in a usual organic solvent and therefore, is not suitable for the production of photoreceptors. There is an example of using a polyamide improved in solubility by methoxymethylation (for example, JP Tokukaihei-5-72787A and JP Tokukaihei-6-186767A), however, it is difficult to sufficiently reduce the formation of black spots, etc. because methoxymethylation remarkably increases the water absorption coefficient.

SUMMARY

In accordance with a first aspect of the invention, an electrophotographic photoreceptor having an interlayer and a photosensitive layer on an electroconductive substrate, wherein the interlayer comprises any one of 1) an N-type semiconductive particle containing at least one of transition metals having an atomic number of 21 to 30, 39, 41 to 48 and 57 to 80, the total amount of the transition metals having an atomic number of 21 to 30, 39, 41 to 48 and 57 to 80 being from 100 ppm to 2.0% by mass, or 2) a metal oxide particle containing a silicon atom in a bond energy spectrum by the X-ray photoelectron spectroscopy at a ratio represented by the following Formula (1):

$$0.02 \leqq Si/M \leqq 0.55 \qquad \text{Formula (1)}$$

Si: a peak intensity of a silicon atom among the bond energy spectrum, and

M: a peak intensity of a metal atom among the bond energy spectrum.

According to the electrophotographic photoreceptor, an electrophotographic photoreceptor can be made under environmental conditions of high temperature and high humidity or low temperature and low humidity, where charging property and sensitivity are stable, variations in charging potential or residual potential are reduced, formation of image defects such as black spots or moire is prevented and an electrophotographic image having a high image density can be formed. An electrophotographic photoreceptor can be made where deterioration of charging property and sensitivity that easily occurs in the case of using charge generation materials or charge transportation materials having high sensitivity and a high-speed property is prevented, variations in charge potential or residual potential are reduced, formation of image defects such as black spots or moiré is prevented and an electrophotographic image having a high image density can be formed.

In accordance with a second aspect of the invention, an apparatus comprising the above-described electrophotographic photoreceptor, with at least one of a charging unit for uniformly charging the electrophotographic photoreceptor, a latent image forming unit for forming an electrostatic latent image on the charged electrophotographic photoreceptor, a developing unit for visualizing the electrostatic latent image formed on the electrophotographic photoreceptor, a transferring unit for transferring to a transfer material the toner image visualized on the electrophotographic photoreceptor, a charge removing unit for removing a charge on the electrophotographic photoreceptor after the transfer, and a cleaning unit for removing the residual toner on the electrophotographic photoreceptor after the transfer.

BRIEF DESCRIPTION OF THE DRAWINGS

The present invention will become more fully understood from the detailed description given hereinbelow and the appended drawings. However, these are not intended as a definition of the limits of the present invention, and wherein.

DETAILED DESCRIPTION OF THE PREFERRED EMBODIMENTS

Figure 1:
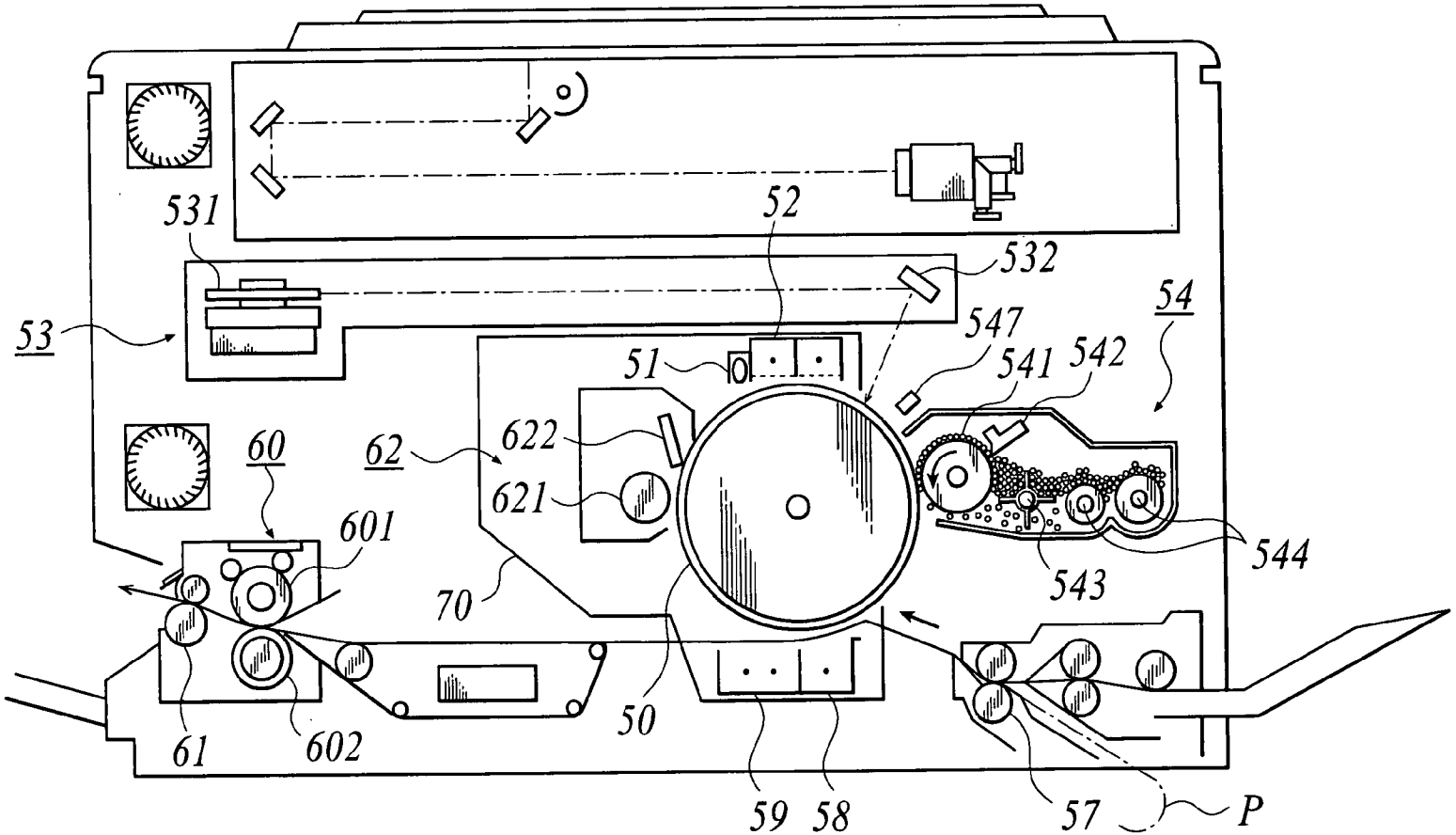
FIG. 1 shows a cross sectional structural view of an image forming apparatus.

Hereinafter, the embodiment will be described in detail.

According to the first aspect of the present invention, an electrophotographic photoreceptor having an interlayer and a photosensitive layer on an electroconductive substrate, wherein the interlayer comprises any one of 1) an N-type semiconductive particle containing at least one of transition metals having an atomic number of 21 to 30, 39, 41 to 48 and 57 to 80, the total amount of the transition metals having an atomic number of 21 to 30, 39, 41 to 48 and 57 to 80 being from 100 ppm to 2.0% by mass, or 2) a metal oxide particle containing a silicon atom in a bond energy spectrum by the X-ray photoelectron spectroscopy at a ratio represented by the following Formula (1):

$$0.02 \leqq Si/M \leqq 0.55 \qquad \text{Formula (1)}$$

Si: a peak intensity of a silicon atom among the bond energy spectrum, and

M: a peak intensity of a metal atom among the bond energy spectrum.

It is preferable that the particle has the N-type semiconductive particle.

It is preferable that as the N-type semiconductive particle, it contains a metal oxide selected from titanium oxide, lead oxide and tin oxide, more preferably the anatase-type titanium oxide pigment. It is preferable that the anatase degree of the anatase-type titanium oxide pigment is from 90 to 100%.

It is preferable that the transition metal is a transition metal having an atomic number of 21 to 30, 39 and 41 to 48, more preferably a niobium element having an atomic number of 41.

It is preferable that the N-type semiconductive particle is surface-treated by a reactive organic silicon compound.

It is preferable that the N-type semiconductive particle has a number average primary particle diameter of from 10 nm to 200 nm.

It is preferable that the surface roughness Rz of the electroconductive substrate is from 0.5 to 2.5 μm.

It is preferable that the film thickness T of the interlayer has a relation represented by the following Formula (2) with the surface roughness Rz:

$$0.7Rz \leqq T \leqq 20(\mu m) \qquad \text{Formula (1)}$$

It is preferable that the surface roughness Rz of the electroconductive substrate is from 0.5 to 2.5 μm.

It is preferable that the interlayer contains a resin having fusion heat of from 0 to 40 J/g.

It is preferable that the interlayer contains a resin having a water absorption coefficient of 5% by mass or less.

It is preferable that the resin is an alcohol-soluble polyamide.

It is preferable that the resin is a polyamide having a repeating unit structure represented by the following Formula (3):

Formula (3)

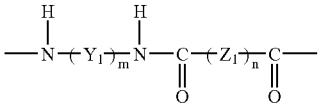

(wherein $Y_1$ represents a group containing a divalent alkyl-substituted cycloalkane, $Z_1$ represents a methylene group, m represents a natural number of 1 to 3 and n represents a natural number of 3 to 20).

It is preferable that the $Y_1$ has the following chemical structure:

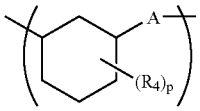

(wherein A represents a single bond or a 1–4C alkylene group, $R_4$ represents an alkyl group and p represents a natural number of 1 to 5).

It is preferable that the particle contains the metal oxide particle.

According to the second aspect of the present invention, an apparatus comprising the electrophotographic photoreceptor as defined in claim 1, with at least one of a charging unit for uniformly charging the electrophotographic photoreceptor, a latent image forming unit for forming an electrostatic latent image on the charged electrophotographic photoreceptor, a developing unit for visualizing the electrostatic latent image formed on the electrophotographic photoreceptor, a transferring unit for transferring to a transfer material the toner image visualized on the electrophotographic photoreceptor, a charge removing unit for removing a charge on the electrophotographic photoreceptor after the transfer, and a cleaning unit for removing the residual toner on the electrophotographic photoreceptor after the transfer.

It is preferable that the apparatus comprises an electrophotographic photoreceptor integrally supported with at least one of the units.

It is preferable that the apparatus has a charging unit, a latent image forming unit, a developing unit, and a transferring unit.

It is preferable that the charging unit is a contact charging system.

In the above electrophotographic photoreceptor having an interlayer and a photosensitive layer on an electroconductive substrate, the interlayer preferably comprises an anatase-type titanium oxide pigment containing a transition metal in an amount of from 100 ppm (=$1.0\times10^{-4}$ (1 ppm means 1 part per million in terms of mass ratio)) to 2.0% by mass.

Other than the above anatase-type titanium oxide pigment, the interlayer also preferably comprises a metal oxide particle containing a silicon atom in a bond energy spectrum by the X-ray photoelectron spectroscopy at a ratio represented by the following Formula (1):

$$0.02 \leqq Si/M \leqq 0.55 \quad (1)$$

Si: a peak intensity of a silicon atom in the bond energy spectrum, and

M: a peak intensity of a metal atom in the bond energy spectrum.

In such electrophotographic photoreceptor, it is preferable that surface roughness Rz of the electroconductive substrate is from 0.5 to 2.5 μm.

In the electrophotographic photoreceptor having an interlayer and a photosensitive layer on an electroconductive support, it is preferable that the interlayer comprises a resin having fusion heat of from 0 to 40 J/g and a water absorption coefficient of 5% by mass or less, and an N-type semiconductive particle containing a transition metal in an amount of from 100 ppm to 2.0% by mass. It is also preferable that surface roughness Rz of the electroconductive substrate is from 0.5 to 2.5 μm.

When the electrophotographic photoreceptor has the above-described construction, environmental dependency of sensitivity or residual potential is reduced, so that a stable image can be obtained even if use conditions rapidly change from high temperature and high humidity to low temperature and low humidity, and moreover, at the formation of digital images in the reversal development, occurrence of image defects such as black spots or moiré is prevented under any conditions, so that an electrophotographic image having high image density and excellent sharpness can be formed.

Examples of the metal oxide particle include metal oxides such as titanium oxide ($TiO_2$), zinc oxide (ZnO), tin oxide ($SnO_2$), zirconium oxide, cerium oxide, iron oxide, aluminum oxide, tungsten oxide and bismuth oxide. Among these, metal oxide particles in IIIa, IVa and IVb are preferable. Specific examples thereof include metal oxides such as titanium oxide ($TiO_2$), tin oxide ($SnO_2$), zirconium oxide, cerium oxide and aluminum oxide.

Among these metal oxide particles, a titanium oxide pigment is most preferable. In the titanium oxide pigment, three types of pigments such as anatase, rutile and brookite each having a different crystalline structure are found. The anatase-type titanium oxide pigment (hereinafter simply referred to as an anatase-type titanium oxide) means a white titanium oxide pigment having a refractive index of 2.55, a tetragonal system as a crystal form, and such a lattice constant that a is 0.378 nm and c is 0.947 nm.

If, for the interlayer, a resin having fusion heat of from 0 to 40 J/g and a water absorption coefficient of 5% by mass or less is used as a binder resin, and an N-type semiconductive particle containing a transition metal in an amount of from 100 ppm to 2.0% by mass is included in the binder resin, humidity-resistance dependency of charging property and sensitivity property in the photoreceptor is improved and formation of fog or image defects such as black spots is prevented, so that an excellent electrophotographic image can be obtained. Specifically, when a resin having the fusion heat and water absorption coefficient as described above is used as a binder resin for dispersing an N-type semiconductive particle containing a transition metal in an amount of from 100 ppm to 2.0% by mass, properties as a semiconductor of the photoreceptor are hardly changed even if external environments of temperature and humidity change, so that improvement effects as described above can be remarkably exerted. More specifically, when the fusion heat is more than 40 J/g, the solvent solubility of the binder is reduced, fine agglomerates of the binder resin are generated in the interlayer, dispersion of the N-type semiconductive particle is deteriorated, and uniformity in microscopic physical properties becomes insufficient, whereby formation of black spots or increase in residual potential may be caused. Further, because uniformity in dispersion of charge generation materials coated on the interlayer also becomes insufficient, there is some possibility that increase in residual potential or deterioration in sensitivity is caused. The fusion heat is more preferably from 0 to 30 J/g, most preferably from 0 to 20 J/g. On the other hand, when the water absorption coefficient is in excess of 5% by mass, water content in the interlayer is elevated, whereby deterioration in electrophotographic properties such as increase in black spots or residual potential and formation of fog may be caused. The water absorption coefficient is more preferably 3% by mass or less.

The fusion heat of the resin is measured by DSC (Differential Scanning Calorimetry). However, the measurement method is not limited to the DSC measurement method as long as the same measurement values as that by DSC are obtained. The fusion heat is determined from a heat-absorption peak area at the temperature rising in DSC.

On the other hand, the water absorption coefficient of the resin is determined by the mass change according to a water-immersion method or by the Karl-Fischer's method.

The binder resin for the interlayer is preferably an alcohol-soluble polyamide resin. As the binder resin for the interlayer in the electrophotographic photoreceptor, a resin having excellent solvent solubility is required to form an interlayer having a uniform film thickness. As such an alcohol-soluble polyamide resin, there is known a copolymer polyamide resin or methoxymethylated polyamide resin comprising a chemical structure having a small number of carbon chains between amide bonds such as 6-nylon described above. However, since these resins are high in a water absorption coefficient, the interlayer formed by using such polyamide has a tendency to be increased in the environmental dependency. As a result, for example, charging property or sensitivity easily changes under the environmental conditions of high temperature and high humidity or low temperature and low humidity, and the formation of black spots is easily caused.

In the alcohol-soluble polyamide resin, when properties such as fusion heat of from 0 to 40 J/g and a water absorption coefficient of 5% by mass or less are imparted, defects of conventional alcohol-soluble polyamide resins are improved and an excellent electrophotographic image can be obtained even if external environments are changed or the electrophotographic photoreceptor is continuously used for a long time.

The alcohol-soluble polyamide resin having properties such as fusion heat of from 0 to 40 J/g and a water absorption coefficient of 5% by mass or less is described below.

As the alcohol-soluble polyamide resin, preferred is a polyamide resin containing a repeating unit structure having from 7 to 30 carbon atoms between amide bonds at a ratio of from 40 to 100% by mol based on the total repeating unit structure.

Here, the repeating unit structure having from 7 to 30 carbon atoms between amide bonds is described. The repeating unit structure means an amide bond unit forming a polyamide resin. This is described by referring to both examples of a polyamide resin (type A) in which the repeating unit structure is formed by condensation of a compound having both an amino group and an carboxylic acid group, and a polyamide resin (type B) in which the repeating unit structure is formed by condensation of a diamino compound and a dicarboxylic acid compound.

More specifically, the repeating unit structure of type A is represented by General Formula (4) and the number of carbon atoms contained in X is the number of carbon atoms of the amide bond unit in the repeating unit structure. On the other hand, the repeating unit structure of type B is represented by General Formula (5), and the number of carbon atoms contained in Y and the number of carbon atoms contained in Z each is the number of carbon atoms of the amide bond unit in the repeating unit structure.

General Formula (4)

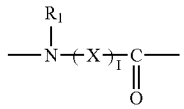

In Formula (4), $R_1$ represents a hydrogen atom, or a substituted or non-substituted alkyl group, X represents a substituted or non-substituted alkylene group, a group containing a divalent cycloalkane or a divalent aromatic group and a mixed structure thereof, and I represents a natural number.

General Formula (5)

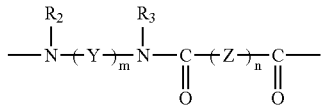

In Formula (5), $R_2$ and $R_3$ each represents a hydrogen atom, or a substituted or non-substituted alkyl group, Y and Z each represents a substituted or non-substituted alkylene group, a group containing a divalent cycloalkane or a divalent aromatic group and a mixed structure thereof, and m and n each represents a natural number.

As described above, the repeating unit structure having from 7 to 30 carbon atoms include a chemical structure having a substituted or non-substituted alkylene group, a group containing a divalent cycloalkane, a divalent aromatic group and a mixed structure thereof. Among these, preferred is a chemical structure having a group containing a divalent cycloalkane.

In the polyamide resin, the number of carbon atoms between amide bonds in the repeating unit structure is from 7 to 30, preferably from 9 to 25, more preferably from 11 to 20. Further, the repeating unit structure having from 7 to 30 carbon atoms between amide bonds occupies 40 to 100% by mol, preferably 60 to 100% by mol, more preferably 80 to 100% by mol, of the total repeating unit structure.

If the number of carbon atoms is less than 7, the polyamide resin has large hygroscopicity and therefore, humidity dependency in electrophotographic properties, particularly, in potential during repeated use is large and further, image defects such as black spots are easily caused. If the number of carbon atoms is more than 30, the polyamide resin is hardly dissolved in a coating solvent and is not suitable for forming a coating film of the interlayer.

Further, when the repeating unit structure having from 7 to 30 carbon atoms between amide bonds occupies less than 40% by mol of the total repeating unit structure, the above-described effects are reduced.

As the preferred polyamide resin of the present invention, a polyamide having a repeating unit structure represented by the following General Formula (3) is given.

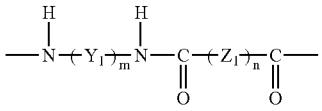

General Formula (3)

In Formula (3), $Y_1$ represents a group containing a divalent alkyl-substituted cycloalkane, $Z_1$ represents a methylene group, m represents a natural number of 1 to 3 and n represents a natural number of 3 to 20.

In the Formula (3), $Y_1$ which represents a group containing a divalent alkyl-substituted cycloalkane has preferably the following chemical structure. In this case, it is possible to obtain the remarkable improvement effects on black spots.

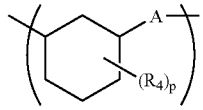

In the chemical structure, A represents a single bond or a 1–4C alkylene group, $R_4$ represents a substituted alkyl group and p represents an integer of 1 to 5. However, a plurality of $R_4$ may be the same or different.

Specific examples of the polyamide resin include the

N-1

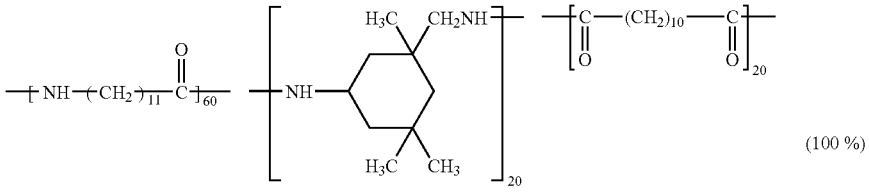

(100 %)

N-2

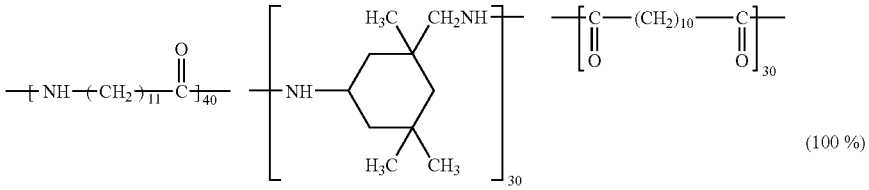

(100 %)

N-3

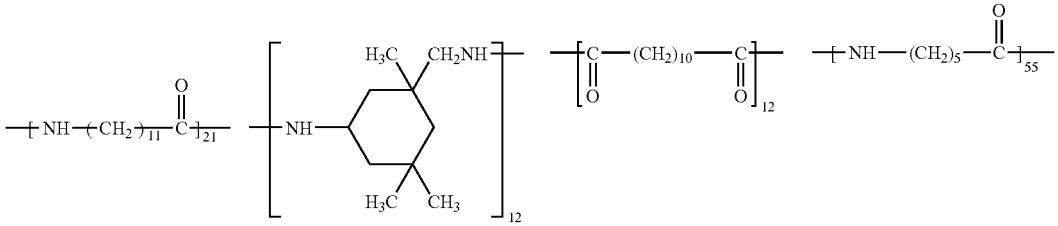

(45 %)

N-4

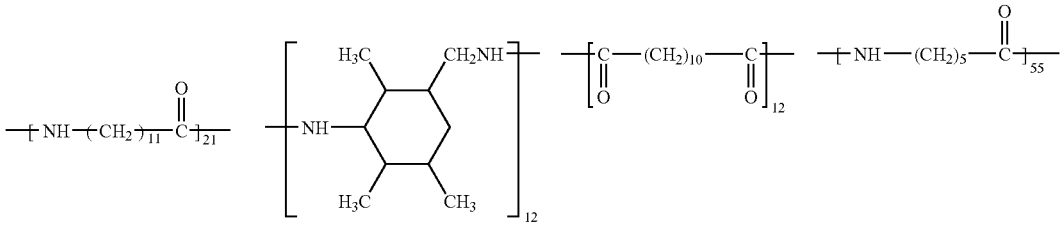

(45 %)

N-5

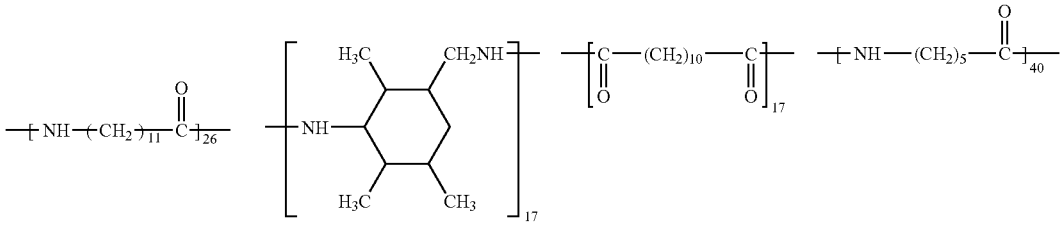

(60 %)

-continued
N-6
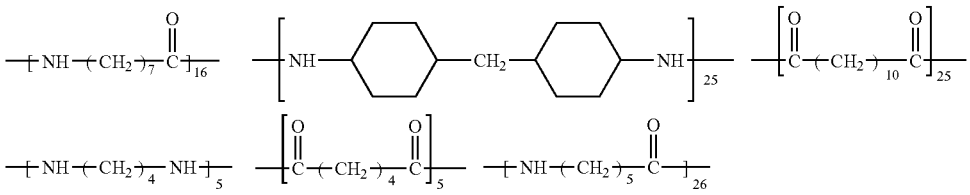
(65 %)
N-7
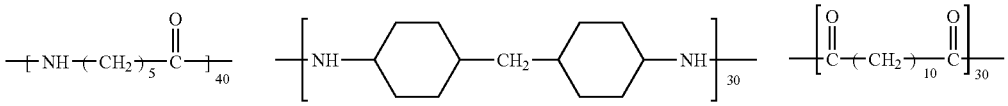
(60 %)
N-8
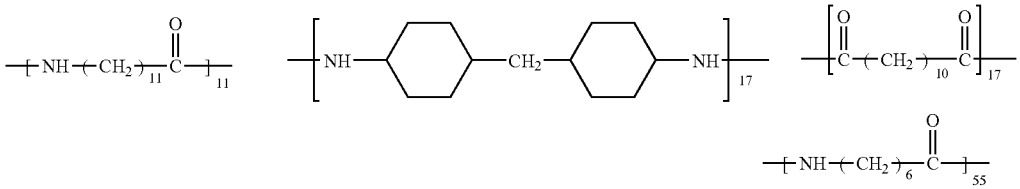
(45 %)
N-9
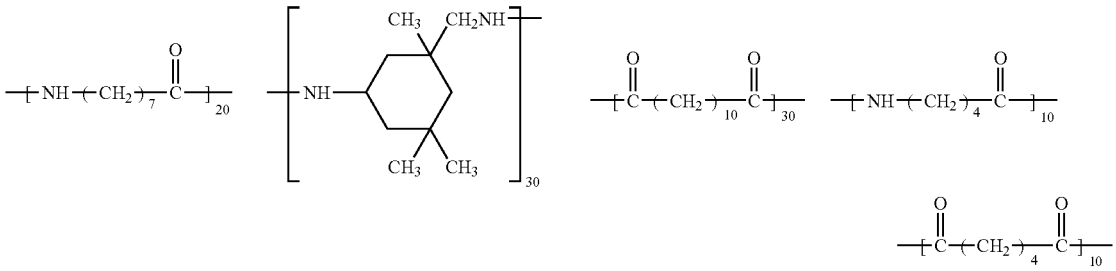
(80 %)
N-10
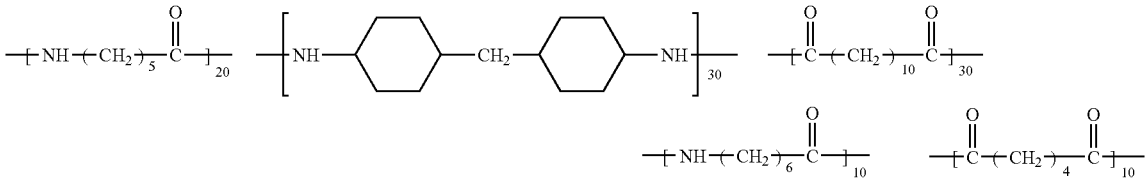
(60 %)
N-11
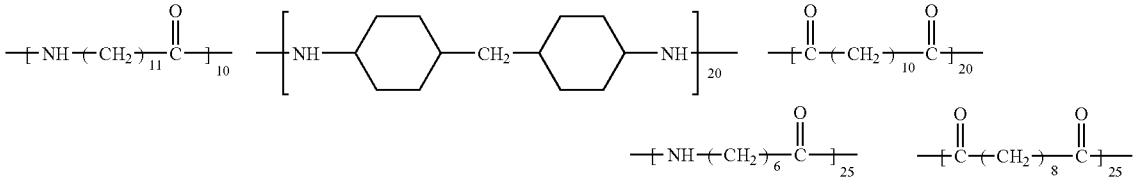
(75 %)

The percent "%" in the parentheses in the above-described specific examples represents a ratio (% by mol) of the repeating unit structure having 7 or more carbon atoms between the amide bonds in the repeating unit structure.

Among the above-described specific examples, polyamide resins in N-1 to N-4 having the repeating unit structure represented by General Formula (3) are particularly preferable.

Furthermore, the polyamide resin has preferably a molecular weight of from 5,000 to 80,000, more preferably from 10,000 to 60,000, in terms of a number average molecular weight. If the number average molecular weight is 5,000 or less, uniformity of the film thickness in the interlayer is deteriorated and it is difficult for the above-described effects to be sufficiently exerted, whereas if it is more than 80,000, solvent solubility of the resin is easily reduced, as a result, an agglomerated resin is easily generated in the interlayer and image defects such as black spots are easily caused.

A part of the polyamide resins is already available in the market, is sold by trade names such as VESTAMELT X1010 and X4685 produced by Daicel/Degussa Co., Ltd, and can be prepared by a general polyamide synthesis method. One example of the synthesis methods is given below.

Synthesis of Exemplified Polyamide Resin (N-1)

In a polymerization kettle equipped with a stirrer, nitrogen, a nitrogen induction tube, a thermometer, a dehydration pipe, etc., 215 parts by mass of lauryl lactam, 112 parts by mass of 3-aminomethyl-3,5,5-trimethylcyclohexyl amine, 153 parts by mass of 1,12-dodecanoic dicarboxylic acid and 2 parts by mass of water were mixed and reacted for 9 hours under heating and under pressure while distilling water. The resulting polymerization product was taken out and the copolymerization composition thereof was determined by $C^{13}$-NMR. It was found that its composition corresponded with that of N-1. Incidentally, the melt flow index (MFI) of the synthesized copolymer was 5 g/10 min under conditions of 230° C./2.16 kg.

As a solvent for dissolving the polyamide resin to prepare a coating liquid, preferred are alcohols having from 2 to 4 carbon atoms, such as ethanol, n-propanol, iso-propanol, n-butanol, t-butanol and sec-butanol. These alcohols are excellent in view of the solubility of polyamide and the coating property of the coating liquid prepared. These solvents are used in an amount of from 30 to 100% by mass, preferably from 40 to 100% by mass, more preferably from 50 to 100% by mass, of the whole solvent. As an auxiliary solvent capable of being used together with the solvent and providing a preferable effect, methanol, benzyl alcohol, toluene, methylene chloride, cyclohexanone, tetrahydrofuran, etc. are given.

Further, an N-type semiconductive particle will be described.

When the N-type semiconductive particle is incorporated into the above interlayer, it is possible that moiré due to laser beams, which is one of image defects, is reduced or that the blocking property of free carriers (electrons or holes penetrating from the electroconductive support, etc.) in the interlayer is elevated. Moreover, when the above-described resin having fusion heat of 0 to 40 J/g and a water absorption coefficient of 5% by mass or less is used as a binder resin for the interlayer, the interlayer having a stable property also against the external changes of temperature and humidity can be obtained. As a result, the electrophotographic properties of the photoreceptor become stable and the photoreceptor having a stable property also against the external changes of temperature and humidity can be obtained.

The N-type semiconductive particle is a fine particle having a property that an electron functions as an electroconductive carrier. Specifically, since the particle has a property that an electron functions as an electroconductive carrier, the interlayer formed by incorporating the N-type semiconductive particle into an insulating binder has a property that a hole injected from the substrate is effectively blocked and an electron injected from the photosensitive layer is blocked in a small amount.

Examples of the N-type semiconductive particle include pigments such as titanium oxide ($TiO_2$), zinc oxide (ZnO) and tin oxide ($SnO_2$). In the present invention, titanium oxide pigments containing a transition metal in an amount of 100 ppm to 2.0% by mass are preferred. Among these, an anatasetype titanium oxide pigment is preferred.

In the interlayer, if the anatase-type titanium oxide pigment containing a transition metal in an amount of 100 ppm (1 ppm means 1 part per million in terms of mass ratio) to 2.0% by mass or the anatase-type titanium oxide pigment containing a silicon atom at the ratio represented by the above-described Formula (1) is dispersed in a binder resin, in particular, changes in the charging property or the sensitivity property are small even if environmental conditions of temperature and humidity are changed, as a result, occurrence of image defects such as black spot easily formed in the reversal development is prevented, so that an electrophotographic image having excellent sharpness can be obtained. If the content of transition metal is less than 100 ppm, dark decay of the charging potential is easily increased, as a result, image density is easily decreased or fog is easily formed, whereas if it is more than 2.0% by mass, black spot is easily formed. The content of the transition metal in the anatase-type titanium oxide pigment is more preferably from 300 ppm to 1.8% by mass.

Although the transition metal in the N-type semiconductive particle can be accordingly measured, for example, the niobium element concentration of the whole anatase-type titanium oxide particle can be quantitatively analyzed by ICP (inductively coupled plasma emission spectrometry).

Further, when the interlayer having a construction as described above is provided on the electroconductive substrate (Rz: 0.5 to 2.5 μm) having a roughened surface, in addition to the above-described effects, there is also brought out a remarkable effect that adhesion between the electroconductive substrate and the photosensitive layer is improved to prevent occurrence of moiré which easily occurs during the image formation using image exposure light such as laser light. In order to prevent formation of black spots which easily occurs by making the surface of the electroconductive substrate rough, the film thickness T of the interlayer preferably satisfies the after described formula (2). Further, the film thickness T of the interlayer is more preferably from Rz to 10 μm. If the film thickness T of the interlayer is less than 0.7 Rz, black spots are easily formed, whereas if it is more than 20 μm, residual potential is easily increased and the image density is easily decreased.

If the metal oxide, in particular, the anatase-type titanium oxide pigment containing a silicon atom at the ratio represented by the above-described Formula (1) is included in the interlayer, the electrophotographic photoreceptor can enhance the rectifying property (a property of allowing negative charge carries in the charge generation layer to pass and blocking positive charges from the electroconductive support) of the interlayer, to reduce the dark decay, to sufficiently ensure the charging stability, and to sufficiently prevent image defects such as black spots. Particularly, when the content of silicon atom in the anatase-type titanium oxide pigment is in the range of from 0.100 to 0.500 at the ratio of (Si/M), remarkable effects are brought out on the above-described charging stability and prevention of image defects such as black spots.

$$0.7Rz \leqq T \leqq 20(\mu m) \quad (2)$$

The X-ray photoelectron spectroscopy is performed in a state where metal oxide particles to be measured are dispersed in the binder resin. For example, the measurement can be performed in a state where the photosensitive layer of the photoreceptor is peeled in a solvent to expose the interlayer. In this case, it has been confirmed that remarkable changes in measurement results depending on the peeling conditions such as a solvent used for the peeling of the photosensitive layer are scarcely observed. Concretely, in order to carry out the X-ray photoelectron spectroscopy, the photoreceptor of which the interlayer is exposed is cut into a size of 4×4 $cm^2$ to prepare a test sample. This sample is subjected to a measurement by use of ESCA-1000 manufactured by Shimadzu Corporation. One example of the measurement conditions is shown as follows.

Acceleration voltage of X-ray source: 10 kV, current: 20 mA,

X-rays: Mg-Kα (target: Mg)

Measuring area of test sample: 2×3 $cm^2$, depth: several Angstroms

In addition, as for the peak intensities of a silicon atom and a metal atom in the bond energy spectrum by the X-ray photoelectron spectroscopy, when the peak area summation of eight elements of C, O, N, Zn, Mg, Al, Si and Ti is set at 100%, the peak intensities (=areas) of a silicon atom and a metal atom are represented by a relative value (%) of the peak area summation. The relative value of the peak intensity value of Si atom 2p electron (Si2p) and the relative value of the peak intensity value of metal atom 2p electron (Me2p) are applied to the Si atom peak intensity: Si and the metal atom peak intensity: M, respectively.

The anatase-type titanium oxide pigment containing a silicon atom at a ratio represented by the above-described Formula (1) may be obtained by incorporating a silicon atom in the production step of a titanium oxide pigment, however, it may also be obtained by subjecting a titanium oxide pigment to a surface treatment by a compound containing a silicon atom.

Further, the metal oxide particle is preferably an anatase-type titanium oxide pigment containing a niobium element in an amount of from 100 ppm to 2.0% by mass. By incorporating a niobium element into the anatase-type titanium oxide pigment, a stable rectifying property of the anatase-type titanium oxide pigment is attained. By using the pigment for the interlayer, there can be obtained an electrophotographic photoreceptor where increase in dark decay easily caused by repetition of use or deterioration in charging stability is sufficiently prevented. When the content of the niobium element is less than 100 ppm, the dark decay of charging potential is easily increased and decrease in image density or increase in fog is easily caused. On the other hand, when the content of the niobium element is more than 2.0% by mass, black spots are easily formed. The content of the niobium element in the anatase-type titanium oxide pigment is more preferably from 300 ppm to 1.8% by mass.

The transition metal of the present invention means a transition element having an atomic number of 21 to 30, 39 to 48 or 57 to 80. Among these transition elements, preferred is a transition element having an atomic number of 21 to 30 or 39 to 48 and having the size nearly equal to or less than that of titanium ion, in particular, if the titanium oxide pigments are used.

Among the above-described transition metals, most preferred is a niobium element having an atomic number of 41 and having an ionic radius approximating to that of titanium ion. By using the electrophotographic photoreceptor having the interlayer comprising the anatase-type titanium oxide pigment containing a niobium element in an amount of from 100 ppm to 2.0% by mass, it is possible to enhance the rectifying property (a property of allowing negative charge carries in the charge generation layer to pass and blocking positive charges from the electroconductive support) of the interlayer, to reduce the dark decay, to sufficiently ensure the charging stability, and to sufficiently prevent image defects such as black spots. Further, when the interlayer comprising the anatase-type titanium oxide pigment containing a niobium element in an amount of from 100 ppm to 2.0% by mass is formed in a sufficient film thickness according to the relation represented by the above-described Formula (1), the above-described effects can be further surely attained.

The anatase-type titanium oxide pigment of the present invention can be produced by a publicly known sulfuric acid method. More specifically, a solution containing titanium sulfate or titanyl sulfate is heated and hydrolyzed to prepare a hydrated titanium dioxide slurry and then, the titanium dioxide slurry is dehydrated and baked to obtain the anatase-type titanium oxide pigment. Next, a method for producing the anatase-type titanium oxide pigment containing a niobium element is described.

Examples of the method for incorporating a silicon atom into the anatase-type titanium oxide pigment crystal include a method for incorporating a hydrolyzable silane compound such as alkoxysilane into the above-described solution containing titanyl sulfate, heating and hydrolyzing the solution to prepare a hydrated titanium dioxide slurry and then, dehydrating and baking the titanium dioxide slurry.

Next, a method for producing the anatase-type titanium oxide pigment containing a niobium element is described.

First, niobium sulfate (a water-soluble niobium compound) is added to the hydrated titanium dioxide slurry obtained by hydrolyzing an aqueous titanyl sulfate solution. The added amount of niobium sulfate as a niobium ion is suitably from 0.15 to 5% by mass based on the amount of titanium in the slurry (in terms of titanium dioxide). More specifically, there can be used (i) a hydrated titanium dioxide slurry obtained by adding from 0.15 to 5% by mass of niobium sulfate as a niobium ion into an aqueous titanyl sulfate solution and then, hydrolyzing the resulting solution, or (ii) a slurry obtained by adding from 0.15 to 5% by mass of niobium sulfate as a niobium ion to a hydrated titanium dioxide slurry obtained by hydrolyzing an aqueous titanyl sulfate solution.

The above-described hydrated titanium dioxide slurry containing a niobium ion, etc. is dehydrated and baked. In general, the baking temperature is suitably from 850 to 1100° C. When the baking temperature is less than 850° C., the baking is not sufficiently performed, while when it exceeds 1100° C., sintering of the particles is generated and dispersibility of the pigments is remarkably impaired. The niobium ions added to the slurry segregate on the surface of the particle during the baking and therefore, are contained in the surface layer in a large amount as a niobium oxide. By this production method, there can be obtained an anatase-type titanium oxide pigment having an average primary particle diameter of from 0.01 to 10 μm and containing a niobium element in an amount of from 100 ppm to 2% by mass.

The anatase degree of the anatase-type titanium oxide is preferably from 90 to 100%. According to the above-described method, an anatase-type titanium oxide having the anatase degree of almost 100% can be prepared. In addition, when the interlayer comprises an anatase-type titanium oxide containing a niobium element in this range, the rectifying property can be preferably and stably achieved, so that the above-described effects can be preferably achieved.

Herein, the anatase degree is a value determined by measuring the intensity IA in the strongest interference line (a plane index 101) of anatase and the intensity IR in the strongest interference line (a plane index 110) of rutile in the powder X-ray diffraction of titanium oxide and using the following formula:

$$\text{Anatase degree (\%)}=100/(1+1.265\times IR/IA)$$

In order to prepare the titanium oxide having the anatase degree of from 90 to 100%, in the preparation of titanium oxide, a solution containing titanium sulfate or titanyl sulfate as a titanium compound is heated and hydrolyzed. According to the method, an anatase-type titanium oxide having the anatase degree of almost 100% can be obtained. Further, when a titanium tetrachloride aqueous solution is neutralized using an alkali, an anatase-type titanium oxide having a high anatase degree can be obtained.

In the interlayer, a binder resin reduced in environmental dependency on temperature and humidity may be used. As such a binder resin, preferred is a binder resin in which a ratio (A/B) between a volume resistivity (A) under the conditions of 30° C. and 80% RH and a volume resistivity (B) under the conditions of 10° C. and 20% RH is from 1 to 1/100. As a specific example thereof, the following resins are preferable.

Specifically, ELVAX4260 (produced by Du Pont) as ethylene type copolymer resins, NL2532 (produced by Mitsui Chemicals, Inc.) and NL2249E (produced by Mitsui Chemicals, Inc.) as polyurethane resins, X1010 (produced by Daicel/Degussa Co., Ltd.) as polyamide resins, and SUPERCHLON (produced by Nippon Paper Industries Co., Ltd.) and GS2000 (produced by Namariichi Corporation) as modified polyolefin resins are given.

Further, as for the volume resistivity of the above-described resins, both of the (A) and (B) above are preferably $10^{12}$ Ωcm or more, more preferably from $10^{12}$ to $10^{16}$ Ωcm. When they are less than $10^{12}$ Ωcm, image defects such as black spots are easily formed, while when they are larger than $10^{16}$ Ωcm, residual potential is easily increased and decrease of image density in the reversal development is easily caused.

A measuring method of the above-described volume resistivity is described.

Measuring Method of Volume Resistivity

The volume resistivity is measured according to JIS K6911-1975. First, a binder resin sample formed in the form of a circular plate having a diameter of about 100 mm and a thickness of 20 μm is subjected to a measurement using a resistance measuring instrument Hiresta IP (manufactured by Mitsubishi Petrochemical Co., Ltd.) and the value calculated from the resistance value after the passing of one minute is defined as the measurement value. Incidentally, the measurement value under high temperature and high humidity conditions is obtained by performing a measurement after the sample is subjected to humidification for 24 hours under the conditions of 30° C. and 80% RH. Further, the measurement value under low temperature and low humidity conditions is obtained by performing a measurement after the sample is subjected to humidification for 24 hours under the conditions of 10° C. and 20% RH.

The average particle diameter of the anatase-type titanium oxide is preferably from 5 nm to 400 nm, more preferably from 10 nm to 400 nm, more preferably from 20 nm to 200 nm and particularly preferably from 20 nm to 100 nm in a number average primary particle diameter.

By an interlayer using an anatase-type titanium oxide having a number average primary particle diameter within the above-described range, dispersion in the layer can be made dense, so that a sufficient electric potential stability can be ensured and occurrence of image defects such as black spots or moiré can be prevented.

The average particle diameter of the N-type semiconductive particle is preferably from 10 nm to 400 nm, more preferably from 15 nm to 200 nm, in terms of a number average primary particle diameter. If the average particle diameter is less than 10 nm, the prevention effect by the interlayer against the moire formation is small. On the other hand, if it is more than 400 nm, the sedimentation of the N-type semiconductive particles easily occurs in the interlayer coating liquid, as a result, uniform dispersibility of the N-type semiconductive particle in the interlayer is reduced and also black spots are increased. The interlayer coating liquid using the N-type semiconductive particle having a number average primary particle diameter in the above-described range is excellent in dispersion stability and the interlayer formed from such a coating liquid has an excellent environmental property in addition to the black spot inhibiting ability, so that the electrophotographic photoreceptor having excellent charging property and sensitivity property can be produced.

For example, in the case of titanium oxide, the number average primary particle diameter of the anatase-type titanium oxide and that of N-type semiconductive particles are measured as a Fere direction number average diameter by image analyze of 100 particles as the primary particles which are magnified 10,000 times by a transfer type electron microscope and randomly observed.

In order to incorporate a silicon atom in a bond energy spectrum by the X-ray photoelectron spectroscopy at a ratio represented by the above-described Formula (1), into the metal oxide particle, when the metal oxide particle is an anatase-type titanium oxide pigment, a method of incorporating a silicon atom into the anatase-type titanium oxide pigment is used. However, it is preferable to subject the anatase-type titanium oxide pigment to a surface treatment using a reactive organic silicon compound. The surface treatment of the anatase-type titanium oxide pigment is described below.

The anatase-type titanium oxide pigment is preferably subjected to the surface treatment by the reactive organic silicon compound. The surface treatment of the anatase-type titanium oxide pigment by the reactive organic silicon compound can be performed by a wet method as described below.

The surface treatment of the anatase-type titanium oxide pigment by the reactive organic silicon compound can be performed by a wet method as described below. Incidentally, the surface treatment by the reactive organic silicon compound means a surface treatment using the reactive organic silicon compound as a treating solution.

Specifically, the above-described anatase-type titanium oxide pigments are added to a solution which is prepared by dissolving or suspending the above-described reactive organic silicon compound in an organic solvent or water, and this mixed solution is subjected to dispersion in a medium on the order of several minutes to a whole day and night. In some cases, this mixed solution is heated. Thereafter, the titanium oxide pigments are filtrated and dried. Thus, the anatase-type titanium oxide pigments where each surface is covered with the organic silicon compound are obtained. In addition, the above-described reactive organic silicon compound may be added to a suspension prepared by dispersing the titanium oxide pigments in an organic solvent or water.

In addition, in order that the titanium oxide particle contains a silicon atom in a bond energy spectrum by the X-ray photoelectron spectroscopy at a ratio represented by the above-described Formula (1), the amount of the reactive organic silicon compound to be used for the above-described surface treatment is preferably from 0.1 to 10 parts by mass, more preferably from 0.1 to 5 parts by mass, per 100 parts by mass of the titanium oxide surface-treated by the above-described metal oxide in the charged amount at the above-described surface treatment. When the amount of the compound to be used for the surface treatment is smaller than that in the above-described range, sufficient effect of the surface treatment cannot be imparted and the silicon content ratio in the above-described Formula (1) becomes less than 0.02, as a result, the rectifying action or dispersibility of the titanium oxide particle within the interlayer is deteriorated, while when the amount of the compound to be used for the surface treatment exceeds the above-described range, the silicon content ratio in the above-described Formula (1) becomes more than 0.55 and the electrophotographic properties are deteriorated, as a result, increase in residual potential or decrease in charging potential is incurred.

The reactive organic silicon compound includes compounds represented by the following General Formula (6), however, the present invention is not limited to the following compounds as long as the compound can perform a condensation reaction with a reactive group such as a hydroxyl group on the surface of the titanium oxide.

General Formula (6)

$$(R)_n\text{—Si—}(X)_{4-n} \tag{6}$$

(wherein Si represents a silicon atom, R represents an organic group in which a carbon atom directly bonds to the silicon atom, X represents a hydrolysable group, and n represents an integer of from 0 to 3).

In the organic silicon compounds represented by General Formula (6), examples of the organic groups represented by R in which a carbon atom directly bonds to the silicon atom include an alkyl group such as methyl, ethyl, propyl, butyl, pentyl, hexyl, octyl and dodecil; an aryl group such as phenyl, tolyl, naphthyl and biphenyl; an epoxy containing group such as γ-glycidoxypropyl and β-(3,4-epoxycyclohexyl)ethyl; a methacryloyl containing group such as γ-acryloxypropyl and γ-methacryloxypropyl; a hydroxyl containing group such as γ-hydroxypropyl and 2,3-dihydroxypropyloxypropyl; a vinyl containing group such as vinyl and propenyl; a mercapto containing group such as γ-mercaptopropyl; an amino containing group such as γ-aminopropyl and N-β (aminoethyl)-γ-aminopropyl; a halogen containing group such as γ-chloropropyl, 1,1,1-trifluoropropyl, nonafluorohexyl and perfluorooctylethyl; and others such as a nitro- or cyano-substituted alkyl group. Examples of the hydrolysable group represented by X include an alkoxy group such as methoxy and ethoxy; a halogen group, and an acyloxy group.

The organic silicon compounds represented by General Formula (6) may be used individually or in combination of two or more types.

In the specific organic silicon compound represented by General Formula (6), when n is 2 or more, a plurality of groups represented by R may be the same or different from each other. When n is 2 or less, similarly, a plurality of groups represented by X may be the same or different from each other. When two or more types of the organic silicon compound represented by General Formula (6) are used, R and X may be the same or different from each other between the different compounds.

Preferable examples of the reactive organic silicon compound include polysiloxane compounds. Among these, methylhydrogen polysiloxane is particularly preferable. The polysiloxane compound having a molecular weight of from 1,000 to 20,000 is easily available and shows an excellent black spot inhibiting ability.

The titanium oxide with its surface treatment finished may be the titanium oxide particles with its surface treatment carried out by an organic silicon compound having a fluorine atom. The surface treatment by the organic silicon compound having a fluorine atom is preferably performed by the above-described wet method.

In the present invention, when using a combination of surface analysis means such as electron spectroscopy for chemical analysis (ESCA), Auger electron spectroscopy (Auger), secondary ion mass spectroscopy (SIMS) and scatter reflection FI-IR, it is confirmed that the surface of the titanium oxide particle is covered with the reactive organic silicon compound.

As another surface treatment for the anatase-type titanium oxide pigment, a surface treatment by at least one or more kinds of compound selected from alumina, silica and zirconia is included.

The treatment by alumina, silica or zirconia means a treatment for precipitating alumina, silica or zirconia on the surface of the anatase-type titanium oxide. The alumina, silica or zirconia precipitated on the surface includes also a hydrate of alumina, silica or zirconia.

The treatments by alumina and silica may be performed simultaneously, however, it is particularly preferable that the treatment by alumina is firstly performed and then the treatment by silica is performed. The treating amount of silica is preferably larger than that of alumina when the treatment by alumina and that by silica are each performed.

The surface treatment of the anatase-type titanium oxide by the metal oxide such as alumina, silica and zirconia may be performed by a wet method. For example, the anatase-type titanium oxide surface-treated by silica or alumina can be prepared by the following procedure.

When using the anatase-type titanium oxide, titanium oxide particles (number average primary particle diameter: 50 nm) are dispersed in water in a concentration of from 50 to 350 g/l to prepare an aqueous slurry, and a water-soluble silicate or a water-soluble aluminum compound is added to the slurry. Then the slurry is neutralized by the addition of an alkali or an acid to precipitate silica or alumina onto the surface of the titanium oxide particles. Thereafter, the particles are filtered, washed and dried to prepare the subjected surface-treated titanium oxide. When sodium silicate is used as the above-described water-soluble silicate, the slurry can be neutralized by an acid such as sulfuric acid, nitric acid and hydrochloric acid. On the other hand, when aluminum sulfate is used as the above-described water-soluble aluminum compound, the slurry can be neutralized by an alkali such as sodium hydroxide and potassium hydroxide.

The amount of the metal oxide to be used in the surface treatment is from 0.1 to 50 parts by mass, preferably from 1 to 10 parts by mass, per 100 parts by mass of titanium oxide particles in the charging amount at the time of the surface treatment. In the above-described case of using alumina and silica for the surface treatment, for example, of anatase-type titanium oxide particles, it is preferable that alumina and silica are each used in an amount of from 1 to 10 parts by mass per 100 parts by mass of titanium oxide particles, and that silica is preferably used in a larger amount than alumina.

In addition, it is preferable that the interlayer is substantially an insulating layer. The insulating layer used herein is one having a volume resistivity of from $1\times10^{8}$ to $1\times10^{15}$ Ω·cm. Further, the interlayer has preferably a volume resistivity of from $1\times10^{9}$ to $1\times10^{14}$ Ω·cm, more preferably from $2\times10^{9}$ to $1\times10^{13}$ Ω·cm. The volume resistivity can be measured as follows.

Measurement conditions: in accordance with JIS C2318-1975

Measuring device: Hiresta IP manufactured by Mitsubishi Petrochemical Co., Ltd.

Measurement conditions: measurement probe HRS

Applied voltage: 500 V

Measurement environment: 30±2° C., 80±5RH %

When the volume resistivity is less than $1\times10^{8}$, charge blocking property of the interlayer is lowered, formation of black spots is increased and also potential-holding property of the electrophotographic photoreceptor is deteriorated, as a result, an excellent image cannot be obtained. On the other hand, when the volume resistivity is more than $10^{15}$ Ω·cm, the residual potential is liable to be increased during repetitive image formation, as a result, an excellent image cannot be obtained.

An interlayer coating liquid prepared for forming the interlayer is composed of the surface-treated N-type semiconductive particle such as the above-described surface-treated titanium oxide; a binder resin; a dispersion solvent; etc. As the dispersion solvent, the same solvent as that for the above-described polyamide resin is suitably used.

In addition to the N-type semiconductive fine particles, metal oxide fine particles are also preferably used. Examples of the metal oxide fine particles include oxides such as cerium oxide, chromium oxide, aluminum oxide, magnesium oxide, silicon oxide and tin oxide. Among these, one or two or more metal oxides, if necessary, are preferably used. Further, these metal oxides may be preferably subjected to a hydrophobilizing treatment by a hydrophobilizing agent such as a titanium coupling agent, a silane coupling agent and a high molecular weight fatty acid or a metal salt thereof.

In order to form the interlayer, the N-type semiconductive fine particle may be incorporated in a binder resin at a ratio of from 10 to 10,000 parts by mass, preferably from 50 to 1,000 parts by mass, per 100 parts by mass of the binder resin. When the N-type semiconductive fine particle is used in this range, the dispersibility of the N-type semiconductive fine particle can be suitably maintained, so that an excellent interlayer having small initial potential variation without causing black spots can be formed.

When the N-type semiconductive fine particle as described above is dispersed and incorporated in the polyamide resin, the electrophotographic property, particularly, the humidity dependency of potential at the repetition of use and the improvement effect of image defects such as black spots can be increased.

Construction of Electrophotographic Photoreceptor

The electrophotographic photoreceptor is described below.

As an electrophotographic photoreceptor, an organic electrophotographic photoreceptor (also, referred as to an organic photoreceptor) to which the interlayer of the invention is adapted, is preferable. The organic photoreceptor means an electrophotographic photoreceptor constructed by allowing an organic compound to have at least one function of a charge generation function and a charge transportation function which are necessary to the construction of the electrophotographic photoreceptor, and examples thereof include any known organic electrophotographic photoreceptor such as a photoreceptor composed of a known organic charge generation material or a known organic charge transportation material and a photoreceptor composed of polymer complex having a charge generation function and a charge transportation function.

The layer construction of the organic photoreceptor is not particularly limited, however, the photoreceptor fundamentally has a photosensitive layer such as a charge generation layer and a charge transportation layer or a single layer having a charge generation/charge transportation layer (a layer having both functions of charge generation and charge transportation in the same layer), however, used may be a construction in which a surface layer is provided on the photosensitive layer. Further, the surface layer may be used in place of the charge transportation layer because it has both functions of a protective layer and a charge transportation function.

Specific construction of the photoreceptor for use in the present invention is described below.

Electroconductive Substrate (Electroconductive Support)

For electroconductive substrates for use in the photoreceptor, a sheet or cylindrical-shaped substrate may either be used. However, in order to make an image forming apparatus small-sized, a cylindrical electroconductive substrate is more preferred.

The cylindrical electroconductive substrate means a cylindrical substrate which is capable of endlessly forming images through its rotation, and the electroconductive substrate having a straightness of 0.1 mm or less and a swing width of 0.1 mm or less is preferred. When this circularity and the swing width exceed these limits, it becomes difficult to form excellent images.

As electroconductive materials, there may be used metal drums composed of aluminum, nickel, etc., plastic drums vacuum coated with aluminum, tin oxide, indium oxide, etc., or paper-plastic drums coated with electroconductive materials. The electroconductive substrates preferably exhibit a specific resistance of $10^{3}$ Ωcm or less at normal temperature.

As the electroconductive substrate, one having formed on the surface thereof a sealing treated alumite coating may be used. The alumite treatment is generally performed in an acidic bath such as chromic acid, sulfuric acid, oxalic acid, phosphoric acid, boric acid and sulfamic acid. Of these, the anodic oxidation treatment in sulfuric acid provides the most preferable result. The anodic oxidation treatment in sulfuric acid is preferably performed at a sulfuric acid concentration of from 100 to 200 g/l, an aluminum ion concentration of from 1 to 10 g/l, a liquid temperature of around 20° C., and an applying voltage of around 20 V, however, the present invention is not particularly limited thereto. Further, the average film thickness of the anodic oxidation coating is usually 20 μm or less, particularly preferably 10 μm or less.

The electrophotographic photoreceptor is preferably prepared such that the surface roughness of the electroconductive substrate is from 0.5 to 2.5 μm in terms of 10-point average surface roughness Rz. When the interlayer comprising the anatase-type titanium oxide containing a transition metal is provided on the electroconductive substrate processed to have such surface roughness, formation of moiré can be effectively prevented even using an interference light such as laser.

Definition and Measuring Method of Surface Roughness Rz

The Rz means a value in standard length of 0.25 mm described in JISB0601-1982. Specifically, the Rz is the value of difference between the average value of altitudes of peaks from the highest to the 5th, and the average value of depths of valleys from the deepest to the 5th, within the standard length of 0.25 mm.

In Example described later, the measurement of the surface roughness Rz was carried out by a surface roughness meter (Surfcorder SE-30H manufactured by Kosaka Laboratory Ltd.). However, other measuring instrument may be used as long as the measuring instrument produces the same result within the range of error.

The electroconductive substrate can be processed to have the surface roughness Rz within the range of the present invention by using sand blast treatment method, etc., where the surface of the electroconductive substrate is subjected to cutting or fine particles are collided on the substrate surface. In addition, the electroconductive substrate can be processed to have the surface roughness Rz within the range of the present invention, also by the above-described chemical surface treatment such as alumite treatment.

Interlayer

In the present invention, the interlayer as described above having a barrier function may be provided between the electroconductive support and the photosensitive layer.

Photosensitive Layer

The photosensitive layer construction of the photoreceptor of the present invention may be one comprising a single layer structure on the above-described interlayer, which has both of the charge generation function and the charge transportation function, however, a more preferable construction may be that the functions of the photosensitive layer are separated into the charge generation layer (CGL) and the charge transportation layer (CTL). By using a function separated construction, an increase in residual potential accompanied with the repetition of use can be controlled at a low level and the other electrophotographic properties are easily controlled according to the object. In a negatively chargeable photoreceptor, it is preferable to use the construction where the charge generation layer (CGL) is disposed on the interlayer and the charge transportation layer (CTL) is further disposed on the CGL. In a positively chargeable photoreceptor, the order of the layer construction in the negatively chargeable photoreceptor is reversed. The most preferable photosensitive layer construction of the present invention is the negatively chargeable photoreceptor construction having the above-described function separated structure.

The photosensitive layer construction of the function separated negatively chargeable photoreceptor is described below.

Charge Generation Layer

The charge generation layer comprises charge generation materials (CGM). As other materials, if desired, binder resins and other additives may be incorporated.

As charge generation materials (CGM), publicly known charge generation materials (CGM) may be used. For example, used may be phthalocyanine pigments, azo pigments, perylene pigments, azulenium pigments, etc. Of these, CGMs, which are capable of minimizing an increase in residual potential accompanied with the repetition of use, are those which comprise a three-dimensional electrical potential structure capable of forming stable agglomerated structure among a plurality of molecules. Specific examples thereof include CGMs of phthalocyanine pigments and perylene pigments having a specific crystalline structure.

As the phthalocyanine pigments, a titanyl phthalocyanine pigment having the following chemical structural formula is commonly known as a charge generation material:

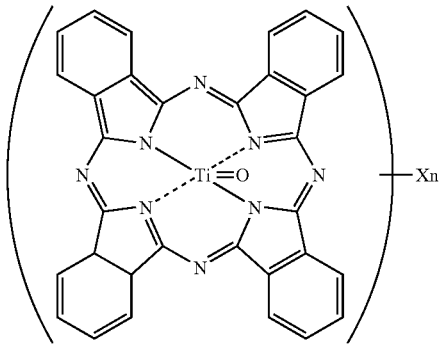

(wherein X represents a halogen atom and n represents a number of from 0 to 1). When the X is a chlorine atom, n is preferably a number of from 0 to 0.5, more preferably from 0 to 0.1.

In the present invention, among the titanyl phthalocyanine pigments, there are preferably used a titanyl phthalocyanine (oxytitanyl phthalocyanine) pigment having a maximum diffraction peak at 27.2° of the X-ray diffraction Bragg angle (2θ±0.2°) with respect to the Cu-Kα X-ray and a titanyl phthalocyanine pigment having noticeable peaks at 7.5° and 28.5° of the same Bragg angle (2θ±0.2°). These titanyl phthalocyanine pigments have such properties that when the environmental conditions of temperature or humidity are changed, sensitivity properties change to result in formation of image defects in the form of black belts or formation of black spots in a high temperature and high humidity environment, or when the continuous printing is performed for a long time, decrease of image density is easily caused. However, when the pigments are combined with the interlayer of the present invention, such defects are solved and an excellent electrophotographic image can be obtained.

Further, the deterioration of a CGM such as titanyl phthalocyanine having a maximum diffraction peak at 27.2° of the Bragg angle 2θ with respect to the Cu-Kα X-ray, benzimidazol perylene having a maximum diffraction peak at 12.4° of the Bragg angle 2θ, or the like, is little caused by the repetition of use. It is possible to minimize the increase in residual potential.

When in the charge generation layer, binders are used as the dispersion media of CGM, the resins known in the art may be used as binders. Examples of the most preferable resins include formal resins, butyral resins, silicon resins, silicon modified butyral resins and phenoxy resins. The ratio of binder resins to charge generation materials is preferably from 20 to 600 parts by mass based on 100 parts by mass of the binder resins. By using these resins, it is possible to minimize the increase in residual potential accompanied with the repetition of use. The film thickness of the charge generation layer is preferably from 0.1 μm to 2 μm.

Charge Transportation Layer

The charge transportation layer comprises charge transportation materials (CTM) as well as binder resins which disperse CTM and form a film. As other materials, if desired, additives such as antioxidants may be incorporated.

As the charge transportation material (CTM), a publicly known charge transportation material (CTM) can be used. For example, triphenylamine derivatives, hydrazone compounds, styryl compounds, benzidine compounds, butadiene compounds, etc. May be used. These charge transportation materials are usually dissolved in appropriate binder resins to form a layer. Among these, CTMs, which are capable of minimizing the increase in residual potential accompanied with the repetition of use, are those having a property such that the difference of the ionization potential of such the CTM and that of the CGM to be used in combination with the CTM is preferably 0.5 (eV) or less, more preferably 0.25 (eV) or less. Of these, CTMs, which are capable of minimizing the increase in residual potential under repeated use, are those which exhibit properties such as high mobility as well as an ionization potential difference of 0.5 eV or less, and preferably 0.30 eV or less, from a combined CGM.

The ionization potentials of the CGM and the CTM are measured by a surface analyzer AC-1 (manufactured by Riken Keiki Co., Ltd.).

Examples of the resins to be used for charge transportation layer (CTL) include a polystyrene, an acryl resin, a methacryl resin, a vinyl chloride resin, a vinyl acetate resin, a poly (vinyl butyral) resin, an epoxy resin, a polyurethane resin, a phenol resin, a polyester resin, an alkyd resin, a polycarbonate resin, a silicone resin, a melamine resin, and a copolymer resin comprising two or more kinds of the repeating unit structure of these resins. Other than these insulating resins, a high molecular organic semiconductor such as poly-N-vinylcarbazole is given.

As the binder for these CTLs, the polycarbonate resin is most preferable. The polycarbonate resin is most preferable since the resin improves the dispersibility of the CTM and the electrophotographic properties. The ratio of the binder resins to the charge transportation materials is preferably from 10 to 200 parts by mass based on 100 parts by mass of the binder resins. The film thickness of the charge transportation layer is preferably from 10 to 50 μm and more preferably from 10 to 40 μm. The charge transportation layer may be a multilayer construction composed of two or more layers, and its uppermost layer may be allowed to have a function as a protective layer.

Further, the charge transportation layer preferably comprises an antioxidant. The antioxidants means materials, as representative ones, which minimize or retard the action of oxygen under conditions of light, heat, discharging, etc., with respect to auto-oxidation occurring materials which exist in the electrophotographic photoreceptor or the surface thereof.

Surface Layer

As a surface layer (a protective layer) of the photoreceptor, a layer using siloxane polycarbonate or crosslinked siloxane resin as a binder may be provided.

The most preferable layer structure of the photoreceptor according to the present invention is exemplified above, however, a photoreceptor layer structure other than the above-described structure may be used in the present invention.

More specifically, examples of the solvents or dispersion media used to form the interlayer, the photosensitive layer and other resin layers of the present invention include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide and methyl cellosolve. The present invention is not limited thereto, however, dichloromethane, 1,2-dichloroethane, methyl ethyl ketone, etc. are preferably used. Further, these solvents may be used individually or in combination of two types or more.

Further, the coating liquid of these respective layers is preferably filtered through a metal filter or a membrane filter before the coating step in order to remove foreign objects or agglomerates in the coating liquid. For example, it is preferable that a pleat type (HDC), a depth type (Profile) or a semidepth type (Profile Star) manufactured by Nihon Poul Co., Ltd. is selected according to characteristics of the coating liquid and filtration is performed.

As a dispersion unit of the N-type semiconductive particles or the metal oxide particles used for preparation of an interlayer coating liquid, any dispersion unit such as a sand mill, a ball mill and an ultrasonic dispersion, etc. may be used.

As coating methods to produce the electrophotographic photoreceptor including the interlayer, there may be used a dip coating method, a spray coating method, a circular amount regulating type coating method, etc. However, in order to minimize the dissolution of the lower layer film during coating of the surface layer side of the photosensitive layer, as well as to achieve a uniform coating, the spray coating method or the circular amount regulating type coating method (being a circular slide hopper type as its representative example) is preferably used. As for a protective layer, the circular amount regulating type coating method is most preferably used. Further, the above-described spray coating is, for example, detailed in Japanese Patent Application Publication Unexamined Tokukaihei-3-90250 and Japanese Patent Application Publication Unexamined Tokukaihei-3-269238, while the circular amount regulating type coating is detailed in, for example, Japanese Patent Application Publication Unexamined Tokukaisho-58-189061.

Next, the image forming method and the image forming apparatus of the present invention are described.

In FIG. 1, reference numeral 50 is a photoreceptor drum (a photoreceptor) which is an image holding body. The photoreceptor is prepared by applying an organic photosensitive layer onto the drum. It is grounded and mechanically rotated clockwise. Reference numeral 52 is a scorotron charging unit (charging unit), and the circumferential surface of the photoreceptor drum 50 is uniformly charged through corona discharge (charging process). Prior to charging with the use of this charging unit 52, the charge on the circumferential surface of the photoreceptor may be removed by exposure from precharging exposed portion 51 using light-emitting diodes in order to eliminate the hysteresis of the photoreceptor due to the most recent image formation.

In an image forming process, any of a non-contact charging system and a contact charging system may be used as a charging system. In the non-contact charging system, as shown in Numeral 51 in FIG. 1, a corona discharging device is most frequently used as a member of the charging unit. The contact charging system is one in which a direct current voltage or a direct current voltage on which an alternating current voltage is superimposed is applied to a charging member such as a magnetic brush or an electroconductive roller having a resistance of about $10^2$ to $10^{10}$ Ω·cm and the charging member is brought into contact with the photoreceptor under pressure to charge the surface of the photoreceptor to a predetermined voltage. By using such a contact charging system, a low voltage operation can be achieved and the amount of ozone or nitrogen oxide generated can be reduced, thus contributing to the long-term stable use of the photoreceptor.

In the contact charging system, when the photoreceptor is used, occurrence of dielectric breakdown or image defects such as black spot, or occurrence of image blurring can be reduced. Particularly under severe conditions such as high temperature and high humidity conditions or low temperature and low humidity conditions, these problems can be reduced.

After the photoreceptor is uniformly charged, image exposure is carried out based on image signals using an image exposure unit 53 as an image exposure unit (image exposure process). The image exposure unit 53 in this figure uses a laser diode (not shown) as the exposure light source. Scanning on the photoreceptor drum is carried out by light of which an optical path is bent by a reflection mirror 532 after the light has passed through a rotating polygonal mirror 531, fθ lens, etc., and an electrostatic image is formed.

The resulting electrostatic latent image is subsequently developed by a developing unit 54 as a developing unit (developing process). Around the photoreceptor drum 50, the developing unit 54 is provided, which stores a developer composed of a toner and a carrier, and development is carried out using developing sleeve 541 which has a built-in magnet and rotates while bearing the developer.

The traveling distance (Td) from the image exposure process to the developing process becomes short when the process speed is high. Therefore, in an electrophotographic photoreceptor having insufficient high-speed adaptability, the electric potential decrease due to image exposure is not completed even when reaching the developing process. However, in the electrophotographic photoreceptor of the present invention, even if the photoreceptor is adapted to the high-speed process where the traveling distance (Td) from the image exposure process to the developing process is 110 m/second or less, sufficient electric potential decrease has been completed in the developing process and also, deterioration in high-speed performance accompanied with the repetition of use is small. Further, the photoreceptor has sufficient high-speed adaptability even under low temperature and low humidity environmental conditions.

The traveling distance (Td) from the image exposure process to the developing process of the present invention can be calculated by dividing the distance (|A~B|) on the photoreceptor between the position (position A on the photoreceptor) at irradiating completion of image exposure light irradiated on the photoreceptor and the position (position B on the photoreceptor) where toner begins to adhere by development, by the line speed (surface line speed of the photoreceptor) of the photoreceptor during the image formation operation.

In a digital image forming method, reversal development is generally performed. The reversal development used herein is an image forming method where the surface of the photoreceptor is uniformly charged by the charging unit 52 and the image exposed portion, that is, the exposed portion potential (exposed portion) of the photoreceptor is visualized by the developing process (unit). On the other hand, the unexposed portion potential is not developed by developing bias potential applied to a developing sleeve 541.

The interior of the developing unit 54 comprises developer stirring/conveying members 544 and 543, a conveying amount regulating member 542, etc. Thus, the developer is stirred, conveyed and supplied to the developing sleeve. The supplying amount of the developer is controlled by the conveying amount regulating member 542. The conveyed amount of the developer is usually within the range of from 20 to 200 mg/cm$^2$ even though the amount varies depending on the line speed of an applied electrophotographic photoreceptor and the specific gravity of the developer.

The developer comprises, for example, a carrier which is prepared by coating insulation resins onto the surface of the above-described ferrite as the core, and a toner which is prepared by externally adding silica, titanium oxide, etc., to colored particles composed of the above-described styrene-acryl based resins as the primary material, colorants such as carbon black, charge control agents, and low molecular weight polyolefin. The developer is regulated on the layer thickness using the conveying amount regulating member, and then conveyed to the development zone, where development is then carried out. At that time, development is carried out while direct current bias voltage, if desired, alternative current bias voltage is applied to the space between the photoreceptor drum 50 and the developing sleeve 541. Further, the developer is subjected to development in a contact or non-contact state with the photoreceptor. The potential measurement of the photoreceptor is carried out by providing a potential sensor 547 at the upper part of the development position as shown in FIG. 1.

After the image formation, the recording paper P is supplied into the transfer zone by the rotation of a paper supplying roller 57 when the timing for transfer is adjusted.

In the transfer zone, a transferring electrode (transferring unit: transferring device) 58 is activated on the circumferential surface of the photoreceptor drum 50 synchronized with the timing of the transfer so as to give the supplied recording paper P a charging polarity opposite to that of the toner to transfer the toner.

Then the electric charge on the recording paper P is removed by a separating electrode (separating device) 59. The recording paper P is separated from the circumferential surface of the photoreceptor drum 50 and conveyed to a fixing device 60. The toner is melted and adhered onto the recording paper by heating and pressing by a heating roller 601 and a pressure roller 602 and the recording paper is then output from the apparatus through a paper ejecting roller 61. The above-described transferring electrode 58 and separating electrode 59 suspend the primary operation after passing of the recording paper P to prepare the next toner image formation. In FIG. 1, a corotron transferring electrification electrode is used for the transferring electrode 58. Set conditions of the transferring electrode cannot be completely defined because they vary depending on the process speed (circumferential speed) of the photoreceptor, etc. However, there may be used such set values that, for example, a transfer current is from +100 to +400 μA, and a transfer voltage is from +500 to +2000 V.

On the other hand, the photoreceptor drum 50, from which the recording paper P has been separated, is subjected to removal and cleaning of the residual toner through pressure contact of a blade 621 of a cleaning unit (cleaning unit) 62, is again subjected to charge elimination using the precharging exposed portion 51, subjected to recharging using the charging unit 52, and subjected to a subsequent image forming process.

Further, reference numeral 70 is a detachable process cartridge in which a photoreceptor, a charging unit, a transferring unit, a separating unit, and a cleaning unit are integrated.

The above described image forming method and the image forming apparatus of the present invention may generally be applied to electrophotographic apparatuses such as electrophotographic copying machines, laser printers, LED printers, liquid crystal shutter printers, etc. In addition, they may widely be applied to apparatuses for display, recording, offset printing, plate making, facsimile, to which electrophotographic techniques are applied.

Embodiment 1

The present invention is described in detail below by referring to Examples, however, the embodiment of the present invention is not limited thereto. Incidentally, the term of "part" represents "part by mass" in the following sentences.

Photoreceptors for evaluation were prepared as follows.

Preparation of Photoreceptor 1

Interlayer 1

On a washed cylindrical aluminum substrate (processed to a surface roughness Rz of 1.0 μm by cutting), the following interlayer coating liquid was coated by a dip coating method so as to form an interlayer 1 having a dry film thickness of 1.0 μm.

The following interlayer dispersion liquid was diluted twice with the same mixed solvent and filtered (filter; Ridgemesh filter manufactured by Nihon Poul Co., Ltd., nominal filtering precision: 5 μm, pressure; 50 kPa) after standing for one night to prepare an interlayer coating liquid.

(Preparation of Interlayer Dispersion Liquid)

Binder resin: ELVAX4260 (produced by Du Pont Co.) 1 part

Anatase-type titanium oxide A1 containing a niobium element in an amount of 0.5% by mass (primary particle diameter: 35 nm, surface treatment: treatment by fluoroethyltrimethoxysilane)

Toluene 10 parts

The above-described components were mixed and dispersed by a batch method for 10 hours using a sand mill disperser. Thus, an interlayer dispersion liquid was prepared.

Charge Generation Layer

The following components were mixed and dispersed using a sand mill disperser to prepare a charge generation layer coating liquid. This coating liquid was coated on the above-described interlayer by a dip coating method so as to form a charge generation layer having a dry film thickness of 0.3 μm.

Y-type oxytitanyl phthalocyanine (the maximum peak angle in X-ray diffraction spectrum using Cu-Kα characteristic X-ray is 27.3° in terms of 2θ) 20 parts polyvinyl butyral (#6000-C produced by Denki Kagaku Kogyo K.K.) 10 parts t-butyl acetate 700 parts 4-methoxy-4-methyl-2-pentanone 300 parts Charge Transportation Layer The following components were mixed and dissolved to prepare a charge transportation layer coating liquid. This coating liquid was coated on the above-described charge generation layer by a dip coating method so as to form a charge transportation layer having a dry film thickness of 24 μm. Thus, a photoreceptor 1 was prepared.

Charge Transportation Material (4-methoxy-4'-(4-methyl-α-phenylstyryl)triphenylamine) 75 parts polycarbonate resin (IUPILON Z-300, produced by Mitsubishi Gas Kagaku Co., Ltd.) 100 parts antioxidant (the following compound A) 2 parts tetrahydrofuran/toluene (volume ratio: 7/3) 750 parts Preparation of Photoreceptors 2 to 21

Photoreceptors 2 to 21 were prepared in the same manner as in the photoreceptor 1 except that the compositions of surface roughness Rz of aluminum substrate, particles of interlayer, binder resin, dry film thickness of interlayer, etc. were changed as shown in Tables 1 and 2.

Compound A

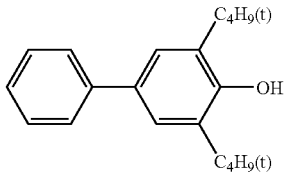

TABLE 1

| | | Interlayer | | | | | | | | | |
|---|---|---|---|---|---|---|---|---|---|---|---|
| | Surface Roughness | Anatase-type Titanium Oxide | | | | Binder Volume Resistivity (Ωcm) | | | | Dry Film Thickness | |
| Photoreceptor No. | of Aluminum Substrate Rz (μm) | Particle | Particle Diameter (nm) | Surface Treatment | Binder Resin | A | B | A/B | Solvent | (μm) | Remark |
| 1 | 1.0 | A1 | 35 | Fluoroethyltrimethoxysilane | ELVAX4260 | $10^{14.50}$ | $10^{15.20}$ | $1/10^{0.70}$ | toluene | 1.00 | within prevention |
| 2 | 1.0 | A1 | 35 | Fluoroethyltrimethoxysilane | X1010 | $10^{14.85}$ | $10^{15.26}$ | $1/10^{0.41}$ | ethanol/n-propyl alcohol (6/1) | 1.00 | within prevention |
| 3 | 1.0 | A1 | 35 | Fluoroethyltrimethoxysilane | NL2532 | $10^{14.64}$ | $10^{15.18}$ | $1/10^{0.54}$ | toluene/ethyl acetate (1/4) | 1.00 | within prevention |
| 4 | 1.0 | A1 | 35 | Fluoroethyltrimethoxysilane | NL2249E | $10^{13.87}$ | $10^{15.12}$ | $1/10^{1.25}$ | toluene/ethyl | 1.00 | within prevention |

TABLE 1-continued

| Photo-receptor No. | Surface Roughness of Aluminum Substrate Rz (μm) | Interlayer: Anatase-type Titanium Oxide Particle | Particle Diameter (nm) | Surface Treatment | Binder Resin | Binder Volume Resistivity (Ωcm) A | B | A/B | Solvent | Dry Film Thickness (μm) | Remark |
|---|---|---|---|---|---|---|---|---|---|---|---|
| | | | | | | | | | acetate (1/4) | | |
| 5 | 1.0 | A1 | 35 | Fluoroethyltri-methoxysilane | SG2000 | $10^{12.69}$ | $10^{14.23}$ | $1/10^{1.54}$ | water | 1.00 | within prevention |
| 6 | 1.0 | A1 | 35 | Fluoroethyltri-methoxysilane | SUPERCHLON | $10^{13.50}$ | $10^{14.98}$ | $1/10^{1.48}$ | toluene | 1.00 | within prevention |
| 7 | 0.4 | A2 | 180 | methylhydrogen-polysiloxane | SG2000 | $10^{12.69}$ | $10^{14.23}$ | $1/10^{1.54}$ | isopropyl alcohol | 0.40 | within prevention |
| 8 | 0.5 | A2 | 180 | methylhydrogen-polysiloxane | SG2000 | $10^{12.69}$ | $10^{14.23}$ | $1/10^{1.54}$ | isopropyl alcohol | 0.30 | within prevention |
| 9 | 0.5 | A2 | 180 | methylhydrogen-polysiloxane | SG2000 | $10^{12.69}$ | $10^{14.23}$ | $1/10^{1.54}$ | water | 0.40 | within prevention |
| 10 | 0.5 | A2 | 180 | methylhydrogen-polysiloxane | SG2000 | $10^{12.69}$ | $10^{14.23}$ | $1/10^{1.54}$ | water | 1.00 | within prevention |
| 11 | 0.5 | A2 | 180 | methylhydrogen-polysiloxane | SG2000 | $10^{12.69}$ | $10^{14.23}$ | $1/10^{1.54}$ | water | 1.50 | within prevention |
| 12 | 1.0 | A3 | 65 | Octyltrimethox-ysilane | X1010 | $10^{14.85}$ | $10^{15.26}$ | $1/10^{0.41}$ | ethanol/ n-propyl alcohol (6/1) | 1.00 | within prevention |

TABLE 2

| Photo-receptor No. | Surface Roughness of Aluminum Substrate Rz (μm) | Interlayer: Anatase-type Titanium Oxide Particle | Particle Diameter (nm) | Surface Treatment | Binder Resin | Binder Volume Resistivity (Ωcm) A | B | A/B | Solvent | Dry Film Thickness (μm) | Remark |
|---|---|---|---|---|---|---|---|---|---|---|---|
| 13 | 1.0 | A3 | 65 | Octyltrime-thoxysilane | X1010 | $10^{14.85}$ | $10^{15.26}$ | $1/10^{0.41}$ | ethanol/ n-propyl alcohol (6/1) | 2.00 | within prevention |
| 14 | 2.5 | A4 | 15 | Fluoroethyltri-methoxysilane | NL2532 | $10^{14.64}$ | $10^{15.18}$ | $1/10^{0.54}$ | toluene/ ethyl acetate (1/4) | 1.75 | within prevention |
| 15 | 2.5 | A4 | 15 | Fluoroethyltri-methoxysilane | NL2532 | $10^{14.64}$ | $10^{15.18}$ | $1/10^{0.54}$ | toluene/ ethyl acetate (1/4) | 2.50 | within prevention |
| 16 | 2.5 | A4 | 15 | Fluoroethyltri-methoxysilane | NL2532 | $10^{14.64}$ | $10^{15.18}$ | $1/10^{0.54}$ | toluene/ ethyl acetate (1/4) | 5.00 | within prevention |
| 17 | 2.5 | A4 | 15 | Fluoroethyltri-methoxysilane | KL2532 | $10^{14.64}$ | $10^{15.18}$ | $1/10^{0.54}$ | toluene/ ethyl acetate (1/4) | 10.00 | within prevention |
| 18 | 2.5 | A4 | 15 | silica · alumina | NL2532 | $10^{14.64}$ | $10^{15.18}$ | $1/10^{0.54}$ | toluene/ ethyl acetate (1/4) | 20.00 | within prevention |
| 19 | 3.0 | A4 | 15 | Fluoroethyltri-methoxysilane | NL2532 | $10^{14.64}$ | $10^{15.18}$ | $1/10^{0.54}$ | toluene/ ethyl acetate (1/4) | 3.0 | within prevention |
| 20 | 1.0 | A5 | 35 | Fluoroethyltri-methoxysilane | NL2532 | $10^{14.64}$ | $10^{15.18}$ | $1/10^{0.54}$ | toluene/ ethyl acetate (1/4) | 3.0 | without prevention |
| 21 | 1.0 | A6 | 35 | Fluoroethyltri- | NL2532 | $10^{14.64}$ | $10^{15.18}$ | $1/10^{0.54}$ | toluene/ | 3.0 | without |

TABLE 2-continued

| | | Interlayer | | | | | | | | | |
|---|---|---|---|---|---|---|---|---|---|---|---|
| | Surface Roughness | Anatase-type Titanium Oxide | | | | Binder Volume Resistivity (Ωcm) | | | | Dry Film Thickness | |
| Photo-receptor No. | of Aluminum Substrate Rz (μm) | Part-icle | Particle Diameter (nm) | Surface Treatment | Binder Resin | A | B | A/B | Solvent | (μm) | Remark |
| | | | | methoxysilane | | | | | ethyl acetate (1/4) | | prevention |

In Tables,

A1 is an anatase-type titanium oxide containing a niobium element in an amount of 0.5% by mass (anatase degree: 100%)

A2 is an anatase-type titanium oxide containing a niobium element in an amount of 1.0% by mass (anatase degree: 95%)

A3 is an anatase-type titanium oxide containing a niobium element in an amount of 300 ppm (anatase degree: 100%)

A4 is an anatase-type titanium oxide containing a niobium element in an amount of 1.8% by mass (anatase degree: 92%)

A5 is an anatase-type titanium oxide containing a niobium element in an amount of 70 ppm (anatase degree: 100%)

A6 is an anatase-type titanium oxide containing a niobium element in an amount of 2.2% by mass (anatase degree: 92%)

ELVAX 4260 is an ethylene-based copolymer resin (produced by Du Pont Chemical Co., Ltd.)

X1010 is a polyamide resin (produced by Daicel/Degussa Co., Ltd.),

NL2532 and NL2249E each is a polyurethane resin (produced by Mitsui Chemicals, Inc.)

SUPERCHLON is a modified polyolefin resin (produced by Nippon Paper Industries Co., Ltd.), and SG2000 is a modified polyolefin resin (produced by Namariichi Corporation).

In the Table above, the film thickness of the interlayer was determined in such a manner that after coating and drying the interlayer, the layer thickness of randomly selected 10 points over the uniform thickness portion of the layer was measured and averaged. The average was denoted as the film thickness of the interlayer. The measurement was performed by eddy current method using a film thickness meter EDDY560C (manufactured by Helmut Fischer GMBTE Co., Ltd.).

In Tables 1 and 2, the surface treatment represents materials used for surface treatment performed on the surface of the anatase-type titanium oxide pigment (however, silica.alumina represents materials precipitated on the surface of the anatase-type titanium oxide pigment).

Further, the volume resistivity of the binder in Tables 1 and 2 was measured as follows.

Measurement Conditions of Volume Resistivity

Measurement conditions: in accordance with JIS K6911-1975

Measuring instrument: Hiresta IP (manufactured by Mitsubishi Petrochemical Co., Ltd.)

Measurement conditions: Measurement probe HRS

Applied voltage: 500 V

Measurement environments: 30±2° C., 80±5RH % 10±2° C., 20±2RH %

Evaluation

The sample obtained was installed in a modified machine of a reversal development method digital copying machine "Konica 7085" manufactured by Konica Corp. (a scorotron charging unit, a semiconductor laser image exposure unit (wavelength: 680 nm), a machine having a reversal developing unit: 85 sheets of A4 size paper/min). The grid voltage of the charging unit was adjusted to −750 V, and at every conditions of low temperature and low humidity (LL: 10° C. and 20% RH), normal temperature and normal humidity (NN: 20° C. and 60% RH) and high temperature and high humidity (HH: 30° C. and 80% RH), 10,000 sheets of continuous A4 size copy image were each formed. Then, an image evaluation was carried out. Further, the unexposed portion potential (VHH) and exposed portion potential (VHL) under high temperature and high humidity (30° C. and 80% RH), and the unexposed portion potential (VLH) and exposed portion potential (VLL) under low temperature and low humidity (10° C. and 20% RH) were measured to calculate |ΔVH| (an absolute value of VHH-VHL) and |ΔVL| (an absolute value of VLH-VLL). Incidentally, the potential above was evaluated by performing the measurement using a potentiometer immediately after completion of the continuous 10,000 sheets copying operation at every environmental conditions. In addition, image density, fog, black spots, moiré and sharpness were evaluated as follows.

Here, operating conditions of "Konica 7085" modified machine was defined as follows.

Line speed of photoreceptor: 420 mm/second

Traveling distance from an image exposure process to a developing process: 0.108 second Charging Conditions Charging Unit: Scorotron Charging Unit (Negative Charging)

Target of Charging Potential: −750 V

Exposure Conditions

Target of Solid Black Image Potential: −50 V

Exposure beam: A semiconductor laser with a wavelength of 680 nm was used as a laser.

Development Conditions

Developer for Konica 7085 was used.

Transfer Conditions

Transferring Electrode: Corona Charging System (Positive Charging)

Separation Conditions

A separation unit of a separation claw unit was used.

Cleaning Conditions

A cleaning unit where a cleaning blade was brought into contact with the cleaning section in the counter direction was used.

Further, image density, fog, black spot, moire, and sharpness were evaluated as described below.

Evaluation Items and Evaluation Method

Image Density: Evaluation under the low temperature and low humidity environment (LL: 10° C. and 20% RH) and the high temperature and high humidity environment (HH: 30° C. and 80% RH)

The measurement was performed using RD-918 manufactured by Macbeth Co., Ltd. Assuming that reflection density of paper was set at "0", the image density was measured by the relative reflection density. As the residual potential more increases due to a number of copies, the image density decreases. The measurement was carried out at the solid black image part after 10,000 copies were each taken.

◎: The density of solid black image was more than 1.2 under both the low temperature and low humidity environment and the high temperature and high humidity environment (Good).

○: The density of solid black image was from 1.0 to 1.2 under both the low temperature and low humidity environment and the high temperature and high humidity environment (practically unproblematic).

X: The density of solid black image was less than 1.0 under any one of the low temperature and low humidity environment and the high temperature and high humidity environment (practically problematic)

Fog: Evaluation under the low temperature and low humidity environment (LL: 10° C. and 20% RH) and the high temperature and high humidity environment (HH: 30° C. and 80% RH).

The fog density was measured in such a manner that the solid white image was determined by the reflection density using RD-918 manufactured by Macbeth Co., Ltd. The reflection density was evaluated by the relative density (assuming that the density of A4 size paper not copied was set at 0.000).

◎: Density was less than 0.010 under both the low temperature and low humidity environment and the high temperature and high humidity environment (Good).

○: Density was from 0.010 to 0.020 under both the low temperature and low humidity environment and the high temperature and high humidity environment (practically unproblematic).

X: Density was more than 0.020 under any one of the low temperature and low humidity environment or the high temperature and high humidity environment (practically problematic).

Black spots (Evaluation was performed using the images having more black spots formed under the low temperature and low humidity environment or the high temperature and high humidity environment)

The black spots were evaluated in such a manner that how many visible black spots having periodicity agreeing with the period of the photoreceptor were formed on the A4 size paper.

◎: Frequency of the black spot having a longer axis diameter of 0.4 mm or more: 3 or less/A4 in all the copies (good).

○: Frequency of the black spot having a longer axis diameter of 0.4 mm or more: One or more copies each having the black spot of from 4 to 10 per A4 size paper was formed (practically unproblematic).

X: Frequency of the black spot having a longer axis diameter of 0.4 mm or more: One or more copies each having the black spot of 11 or more per A4 size paper was formed (practically problematic).

Evaluation of moiré (The evaluation was performed by use of a half tone image or a white background image under the conditions of normal temperature and normal humidity.)

◎: No occurrence of moiré on a half tone image and a white background image (Good)

○: Slight occurrence of moiré on a half tone image (practically unproblematic)

X: Noticeable occurrence of moiré on a half tone image or a white background image (practically problematic).

Sharpness

The sharpness of the images was evaluated in such a manner that the images were formed under both environments of low temperature and low humidity (10° C.20% RH) and high temperature and high humidity (30° C.80% RH). 3 point and 5 point character images were formed and evaluated based on the following judgment criteria.

◎: Both of 3 point character images and 5 point character images were clear and could be easily read under both the low temperature and low humidity environment and the high temperature and high humidity environment (Good).

○: A part of 3 point character images could not be read, and 5 point character images were clear and could be easily read under any one of the low temperature and low humidity environment and the high temperature and high humidity environment (practically unproblematic).

X: 3 point character images could scarcely be read, and a part or the whole of 5 point character images could not be read under any one of the low temperature and low humidity environment and the high temperature and high humidity environment (practically problematic).

The evaluation results are shown in Table 3.

TABLE 3

| | Potential Evaluation | | | | | | Image Evaluation Sharpness | | | | | |
|---|---|---|---|---|---|---|---|---|---|---|---|---|
| Photoreceptor No. | VHH (−V) | VHL (−V) | \|ΔVH\| (V) | VLH (−V) | VLL (−V) | \|ΔVL\| (V) | Image Density | Fog | Black Spot | Moire | Sharpness | Remark |
| 1 | 740 | 60 | 680 | 760 | 110 | 650 | ◎ | ◎ | ◎ | ◎ | ◎ | within invention |
| 2 | 740 | 65 | 675 | 760 | 115 | 645 | ◎ | ◎ | ◎ | ◎ | ◎ | within invention |
| 3 | 740 | 65 | 675 | 760 | 115 | 645 | ◎ | ◎ | ◎ | ◎ | ◎ | within invention |
| 4 | 740 | 75 | 665 | 760 | 125 | 635 | ◎ | ◎ | ◎ | ◎ | ◎ | within invention |
| 5 | 735 | 60 | 675 | 750 | 110 | 640 | ◎ | ◎ | ◎ | ◎ | ◎ | within invention |
| 6 | 735 | 65 | 670 | 750 | 115 | 635 | ◎ | ◎ | ◎ | ◎ | ◎ | within invention |
| 7 | 720 | 80 | 640 | 740 | 130 | 610 | ◎ | ◎ | ○ | ○ | ○ | within invention |
| 8 | 730 | 85 | 645 | 740 | 135 | 605 | ◎ | ◎ | ○ | ○ | ○ | within invention |
| 9 | 740 | 90 | 650 | 740 | 140 | 600 | ◎ | ◎ | ○ | ◎ | ○ | within invention |

TABLE 3-continued

| Photoreceptor No. | Potential Evaluation VHH (−V) | VHL (−V) | \|ΔVH\| (V) | VLH (−V) | VLL (−V) | \|ΔVL\| (V) | Image Evaluation Sharpness Image Density | Fog | Black Spot | Moire | Sharpness | Remark |
|---|---|---|---|---|---|---|---|---|---|---|---|---|
| 10 | 750 | 70 | 680 | 750 | 120 | 630 | ◎ | ◎ | ◎ | ◎ | ◎ | within invention |
| 11 | 750 | 65 | 685 | 760 | 115 | 645 | ◎ | ◎ | ◎ | ◎ | ◎ | within invention |
| 12 | 750 | 70 | 680 | 750 | 120 | 630 | ◎ | ◎ | ◎ | ◎ | ◎ | within invention |
| 13 | 750 | 65 | 685 | 750 | 115 | 635 | ◎ | ◎ | ◎ | ◎ | ◎ | within invention |
| 14 | 750 | 125 | 625 | 750 | 160 | 590 | ◎ | ◎ | ◎ | ◎ | ○ | within invention |
| 15 | 750 | 60 | 690 | 770 | 110 | 660 | ◎ | ◎ | ◎ | ◎ | ◎ | within invention |
| 16 | 750 | 70 | 680 | 770 | 130 | 640 | ◎ | ◎ | ◎ | ◎ | ◎ | within invention |
| 17 | 750 | 65 | 685 | 770 | 115 | 655 | ◎ | ◎ | ◎ | ◎ | ◎ | within invention |
| 18 | 700 | 160 | 540 | 740 | 180 | 560 | ○ | ○ | ◎ | ◎ | ○ | within invention |
| 19 | 730 | 130 | 600 | 730 | 170 | 570 | ◎ | ◎ | ○ | ○ | ○ | within invention |
| 20 | 650 | 200 | 450 | 730 | 230 | 500 | X | X | ○ | ◎ | X | without invention |
| 21 | 700 | 150 | 550 | 730 | 140 | 540 | ○ | ○ | X | ◎ | X | without invention |

As is apparent from Table 3, as compared with the photoreceptors 20 using an anatase-type titanium oxide pigment containing a niobium element in an amount of 70 ppm or the photoreceptors 21 using an anatase-type titanium oxide pigment containing a niobium element in an amount of 2.2% by mass, the photoreceptors 1 to 19 of the present invention having an interlayer comprising an anatase-type titanium oxide pigment containing a niobium element in an amount of from 100 ppm to 2% by mass have excellent stability of unexpoed portion potential and exposed portion potential under the environmental conditions of high temperature and high humidity, and low temperature and low humidity, have fully potential differences |ΔVH| and |ΔVL| and therefore, image density is sufficient, fog density is reduced and improvement effects on black spots, etc. are noticeable, as a result, an electrophotographic image having excellent sharpness is obtained. Particularly, noticeable improvement effects are found on the photoreceptors 1 to 6, 10 to 13 and 15 to 17 that the surface roughness Rz of the electroconductive support is from 0.5 to 2.5 μm, the volume resistivity of the interlayer resin is $10^{12}$ Ωcm or more under the conditions of 30° C. and 80% RH, a ratio (A/B) between the volume resistivity (A) under the conditions of 30° C. and 80% RH and the volume resistivity (B) under the conditions of 10° C. and 20% RH is from 1 to 1/100, and the film thickness of the interlayer is from Rz to 10 μm. On the other hand, the photoreceptor 20 is large in decrease of an unexposed portion potential VHH and in increase of an exposed portion potential VLL and therefore, decrease in image density and formation of fog are caused, as a result, the image sharpness is also reduced. Further, the photoreceptor 21 using an anatase-type titanium oxide pigment containing a niobium element in an amount of 2.2% by mass is noticeable in the formation of black spots, as a result, the image sharpness is also reduced.

Each of the thus obtained photoreceptors 16, 17, 18, 20 and 21 was installed in EPSON LP-2400 (manufactured by Epson: a printer for A4 size paper 16 sheets/minute) fundamentally having a contact charging roller, and evaluated by changing the evaluation items under respective environments of high temperature and high humidity (30° C. and 80% RH), and low temperature and low humidity (10° C. and 20% RH).

Exposure Conditions:

Target of exposed portion potential: The exposure amount was set such that the exposed portion potential was made to less than −50 V.

Exposure beam: An image exposure having a dot density of 600 dpi (dpi means the number of dots per 2.54 cm) was carried out. A semiconductor laser with a wavelength of 780 nm was used as a laser.

Development conditions: A reversal development using a non-magnetic one-component developer.

Evaluation Items and Evaluation Method a. Evaluation of Residual Potential (Potential Change in Solid Black Image)

Under the environments of low temperature and low humidity (LL: 10° C. and 20% RH) and high temperature and high humidity (HH: 30° C. and 80% RH), 10,000 prints were performed under a single sheet intermittent mode, using an A4 size image including a character image with a pixel ratio of 7%, a half tone image, a solid white image and a solid black image each occupying ¼ area of the image. Thereafter, the initial print and the $10{,}000^{th}$ print were evaluated on the potential change (|ΔV|) in the solid black image portion at the development position. As the |ΔV| is smaller, increase in the residual potential accompanied with the repetition of use is smaller.

◎: Potential change |ΔV| in a solid black image portion was less than 50 V (Good).

○: Potential change |ΔV| in a solid black image portion was from 50 V to 150 V (practically unproblematic).

X: Potential change |ΔV| in a solid black image portion was more than 150 V (practically problematic).

b. Evaluation of Charging Potential (Potential Change in Solid White Image)

Under the environments of low temperature and low humidity (LL: 10° C. and 20% RH) and high temperature and high humidity (HH: 30° C. and 80% RH), 10,000 prints were performed under a single sheet intermittent mode, using an A4 size image including a character image with a pixel ratio of 7%, a half tone image, a solid white image and a solid black image each occupying ¼ area of the image. Thereafter, the initial print and the $10{,}000^{th}$ print were evaluated on the potential change (|ΔV|) in the solid white image portion at the development position. As the |ΔV| is smaller, change in the charging potential accompanied with the repetition of use is smaller.

◎: Potential change |ΔV| in a solid white image portion was less than 50 V (Good).

○: Potential change |ΔV| in a solid white image portion was from 50 V to 150 V (practically unproblematic).

X: Potential change |ΔV| in a solid white image portion was more than 150 V (practically problematic).

c. Image Density: Evaluation Under the Low Temperature and Low Humidity Environment (LL: 10° C. and 20% RH) and the High Temperature and High Humidity Environment (HH: 30° C. and 80% RH)

The measurement was performed using RD-918 manufactured by Macbeth Co., Ltd. Assuming that the reflection density of paper was set at "0", the image density was measured by the relative reflection density. As the residual potential more increases due to a number of copies, the image density more decreases. The measurement was carried out at the solid black image portion after 10,000 copies were each taken.)

◎: Solid black image density was more than 1.2 under both the low temperature and low humidity environment and the high temperature and high humidity environment (Good).

○: Solid black image density was from 1.0 to 1.2 under both the low temperature and low humidity environment and the high temperature and high humidity environment (practically unproblematic).

X: Solid black image density was less than 1.0 under any one of the low temperature and low humidity environment and the high temperature and high humidity environment (practically problematic)

d. Fog: Evaluation under the low temperature and low humidity environment (LL: 10° C. and 20% RH) and the high temperature and high humidity environment (HH: 30° C. and 80% RH).

The fog density was measured in such a manner that the solid white image density was determined by the reflection density using RD-918 manufactured by Macbeth Co., Ltd. The reflection density was evaluated by the relative density (assuming that the density of A4 size paper not copied was set at 0.000). The measurement was carried out at the solid black image portion after 10,000 copies were each taken.

◎: Density was less than 0.010 under both the low temperature and low humidity environment and the high temperature and high humidity environment (Good).

○: Density was from 0.010 to 0.020 under both the low temperature and low humidity environment and the high temperature and high humidity environment (practically unproblematic).

X: Density was more than 0.020 under any one of the low temperature and low humidity environment and the high temperature and high humidity environment (practically problematic)

e. Dielectric Breakdown: Evaluation Under the Low Temperature and Low Humidity Environment (LL: 10° C. and 20% RH) and the high Temperature and High Humidity Environment (HH: 30° C. and 80% RH)

○: A dielectric breakdown of the photoreceptor due to charging leak was not generated under the low temperature and low humidity environment or the high temperature and high humidity environment.

X: A dielectric breakdown of the photoreceptor due to charging leak was generated under the low temperature and low humidity environment or the high temperature and high humidity environment.

f. Periodic Image Defects (Under High Temperature and High Humidity Environment (HH: 30° C. and 80% RH))

Periodic image defects were evaluated in such a manner that how many visible image defects such as black spot or black streak having periodicity agreeing with the period of the photoreceptor were formed on the A4 size paper.

◎: Frequency of the image defects having a longer axis diameter of 0.4 mm or more: 5 or less image defects/A4 in all the copies (good).

○: Frequency of the image defect having a longer axis diameter of 0.4 mm or more: One or more copies each having the image defects of from 6 to 10 per A4 size paper was formed (practically unproblematic).

X: Frequency of the image defect having a longer axis diameter of 0.4 mm or more: One or more copies each having the image defects of 11 or more per A4 size paper was formed (practically problematic).

g. Sharpness

The sharpness of the images was evaluated with character deformation of the images formed under both the environments of low temperature and low humidity (10° C. and 20% RH), and high temperature and high humidity (30° C. and 80% RH). 3 point and 5 point character images were formed and evaluated based on the following judgment criteria.

◎: Image blurring was not formed. Both of 3 point and 5 point character images were clear and could be easily read.

○: Image blurring was slightly formed. A part of 3 point character images could not be read, and 5 point character images were clear and could be easily read.

X: Image blurring was formed. 3 point character images could scarcely be read, and a part or the whole of 5 point character images could not be read.

As is apparent from the Table 4, the electrophotographic photoreceptors 16 to 18 are excellent in the stability of residual potential and charging potential under the high temperature and high humidity environment and the low temperature and low humidity environment and therefore, the image density is sufficiently high and the fog density is low. Moreover, the dielectric breakdown is not generated and improvement effects on black spot, etc. are remarkable, as a result, an electrophotographic image having excellent sharpness is obtained. The photoreceptors 16 to 18 each having an interlayer comprising an anataze-type titanium oxide containing a niobium element in a metal oxide particle are remarkable in the improvement effects on respective evaluation items. On the other hand, the photoreceptor 20 and 21 each having the niobium content outside the scope is noticeable in formation of black spots and also, the image sharpness is reduced.

TABLE 4

| Photo-receptor No. | Potential Evaluation (Residual Potential) LL | HH | Potential Evaluation (Charging Potential) LL | HH | Image Evaluation Image Density | Fog | Dielectric Breakdown | Black Spot | Sharpness | Remark |
|---|---|---|---|---|---|---|---|---|---|---|
| 16 | ◎ | ◎ | ◎ | ◎ | ◎ | ◎ | ○ | ◎ | ◎ | within invention |
| 17 | ◎ | ◎ | ◎ | ◎ | ◎ | ◎ | ○ | ◎ | ◎ | within invention |
| 18 | ◎ | ◎ | ◎ | ◎ | ◎ | ◎ | ○ | ◎ | ◎ | within invention |
| 20 | ○ | ○ | ○ | ○ | ○ | ○ | ○ | ○ | X | without invention |
| 21 | ○ | ○ | ○ | ○ | ○ | ○ | ○ | X | X | without invention |

Embodiment 2

The present invention is described in detail below by referring to other examples.

Preparation of Titanium Oxide Pigment B1

In a solution prepared by dissolving 3 parts by mass of fluoroethyltrimethoxysilane in 100 parts by mass of an alcohol/water (10/1) solvent, 100 parts by mass of an anatase-type titanium oxide pigment (primary particle diameter: 35 nm) containing 0.5% by mass of a niobium element was mixed and media-dispersed. After carrying out the media dispersion a whole day and night, the anatase-type titanium oxide pigment was taken out from the media dispersion liquid and dried to obtain a titanium oxide pigment B1 (anatase degree: 100%) surface-treated by fluoroethyltrimethoxysilane. The resulting pigment was dispersed under the following conditions to prepare a dispersion liquid. The dispersion liquid was coated on an electroconductive support and dried so as to form a film with a dry film thickness of 1.0 μm. Using the coated and dried sample, the above-described X-ray photoelectron spectroscopy was carried out. It was found that a Si atom was 8.6%, a Ti atom was 18.6% and Si/Ti was 0.462.

Dispersion Liquid

Binder resin: resin ELVAX4260 (produced by Du Pont Co.) 1 part

Titanium oxide pigment B1 3.0 parts

Toluene 10 parts

The above-described components were mixed and dispersed by a batch method for 10 hours using a sand mill disperser. Thus, a dispersion liquid was prepared.

Preparation of Titanium Oxide Pigment B2

In a solution prepared by dissolving 4 parts by mass of methyltrimethoxysilane in 100 parts by mass of an alcohol/water (10/1) solvent, 100 parts by mass of an anatasetype titanium oxide pigment (primary particle diameter: 80 nm) containing 0.5% by mass of a niobium element was mixed and mediadispersed. After carrying out the media dispersion a whole day and night, the anatasetype titanium oxide pigment was taken out from the media dispersion liquid and dried to obtain a titanium oxide pigment B2 (anatase degree: 100%) surfacetreated by methyltrimethoxysilane. A dispersion liquid was prepared in the same manner except for using the pigment B2 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.510.

Preparation of Titanium Oxide Pigment B3

In a solution prepared by dissolving 1.5 parts by mass of octyltrimethoxysilane in 100 parts by mass of an alcohol/water (10/1) solvent, 100 parts by mass of an anatase type titanium oxide pigment (primary particle diameter: 65 nm) containing 0.5% by mass of a niobium element was mixed and media-dispersed. After carrying out the media dispersion a whole day and night, the anatase-type titanium oxide pigment was taken out from the media dispersion liquid and dried to obtain a titanium oxide pigment B3 (anatase degree: 95%) surface-treated by octyltrimethoxysilane. A dispersion liquid was prepared in the same manner except for using the pigment B3 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.113.

Preparation of Titanium Oxide Pigment B4

In a solution prepared by dissolving 2 parts by mass of methyltrimethoxysilane in 100 parts by mass of an alcohol/water (10/1) solvent, 100 parts by mass of an anatase-type titanium oxide pigment (primary particle diameter: 40 nm) containing 0.5% by mass of a niobium element was mixed and media-dispersed. After carrying out the media dispersion a whole day and night, the anatasetype titanium oxide pigment was taken out from the media dispersion liquid and dried to obtain a titanium oxide pigment B4 (anatase degree: 100%) surface-treated by methyltriinethoxysilane. A dispersion liquid was prepared in the same manner except for using the pigment B4 in place of the titanium oxide pigment B1 of the above described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.340.

Preparation of Titanium Oxide Pigment B5

In a solution prepared by dissolving 0.1 part by mass of methyihydrogen polysiloxane in 100 parts by mass of an alcohol/water (10/1) solvent, 100 parts by mass of an anatase-type titanium oxide pigment (primary particle diameter: 15 nm) containing 300 ppm of a nobium element was mixed and media-dispersed. After carrying out the media dispersion a whole day and night, the anatase-type titanium oxide pigment was taken out from the media dispersion liquid and dried to obtain a titanium oxide pigment B5 (anatase degree: 100%) surfacetreated by methylhydrogen polysiloxane. A dispersion liquid was prepared in the same manner except for using the pigment B5 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.020.

Preparation of Titanium Oxide Pigment B6

In a solution prepared by dissolving 2 parts by mass of methyltrimethoxysilane in 100 parts by mass of an alcohol/water (10/1) solvent, 100 parts by mass of an anatase-type titanium oxide pigment (primary particle diameter: 180 nm) containing 1.8% by mass of a niobium element was mixed and media-dispersed. After carrying out the media dispersion a whole day and night, the anatasetype titanium oxide pigment was taken out from the media dispersion liquid and dried to obtain a titanium oxide pigment B6 (anatase degree: 92%) surface-treated by methyltrimethoxysilane. A dispersion liquid was prepared in the same manner except for using the pigment B6 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.340.

Preparation of Titanium Oxide Pigment B7

In a solution comprising 100 parts by mass of an alcohol/water (10/1) solvent, 100 parts by mass of an anatase-type titanium oxide pigment (primary particle diameter: 35 nm) containing 0.5% by mass of a niobium element was mixed and media-dispersed. After carrying out the media dispersion a whole day and night, the anatase-type titanium oxide pigment was taken out from the media dispersion liquid and dried to obtain a titanium oxide pigment B7 (anatase degree: 92%) solvent-treated by the alcohol/water (10/1). A dispersion liquid was prepared in the same manner except for using the pigment B7 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.010.

Preparation of Titanium Oxide Pigment B8

In a solution prepared by dissolving 5 parts by mass of methyltrimethoxysilane in 100 parts by mass of an alcohol/water (10/1) solvent, 100 parts by mass of an anatase-type titanium oxide pigment (primary particle diameter: 35 nm) containing 0.5% by mass of a niobium element was mixed and media-dispersed. After carrying out the media dispersion a whole day and night, the anatase-type titanium oxide pigment was taken out from the media dispersion liquid and dried to obtain a titanium oxide pigment B8 (anatase degree: 92%) surface-treated by methyltrimethoxysilane. A dispersion liquid was prepared in the same manner except for using the pigment B8 in place of the titanium oxide pigment B1 of the above-described dispersion liquid. The dispersion liquid was coated on an electroconductive support and dried so as to form a film with a dry film thickness of 1.0 μm. Using the coated and dried sample, the above-described X-ray photoelectron spectroscopy was carried out. From the measurement results, Si/Ti was 0.565.

Photoreceptor 1 of the second embodiment was prepared in the same manner photoreceptor 1 of the first embodiment, except that titanium oxide pigment B1 was used instead of titanium oxide pigment A1.

Preparation of Photoreceptors 2 to 23

Photoreceptors 2 to 23 were prepared in the same manner as in the photoreceptor 1 except that the compositions of surface roughness Rz of aluminum substrate, anatase-type titanium oxide of interlayer, binder resin, dry film thickness of interlayer, etc. were changed as shown in Tables 5 and 6.

TABLE 5

| | | Interlayer | | | | | | | | | | | |
|---|---|---|---|---|---|---|---|---|---|---|---|---|---|
| | | Titanium Oxide Pigment | | | | | | | | | | | |
| Photo-receptor | Surface Roughness of Aluminum Substrate | | Particle Diameter | Content of niobium element (% by | Surface | | Binder | Binder Volume Resistivity (Ωcm) | | | | Dry Film Thickness | |
| No. | Rz (μm) | Type | (nm) | mass) | Treatment | Si/Ti | Resin | A | B | A/B | Solvent | (μm) | Remark |
| 1 | 1.0 | A1 | 35 | 0.5 | Fluoroethyltri-methoxysilane | 0.462 | ELVAX4260 | $10^{14.50}$ | $10^{15.20}$ | $1/10^{0.70}$ | toluene | 1.00 | Within invention |
| 2 | 1.0 | A1 | 35 | 0.5 | Fluoroethyltri-methoxysilane | 0.462 | X1010 | $10^{14.85}$ | $10^{15.26}$ | $1/10^{0.41}$ | *1 | 1.00 | Within invention |
| 3 | 1.0 | A1 | 35 | 0.5 | Fluoroethyltri-methoxysilane | 0.462 | NL2532 | $10^{14.64}$ | $10^{15.18}$ | $1/10^{0.54}$ | *2 | 1.00 | Within invention |
| 4 | 1.0 | A1 | 35 | 0.5 | Fluoroethyltri-methoxysilane | 0.462 | NL2249E | $10^{13.87}$ | $10^{15.12}$ | $1/10^{1.25}$ | *2 | 1.00 | Within invention |
| 5 | 1.0 | A1 | 35 | 0.5 | Fluoroethyltri-methoxysilane | 0.462 | SG2000 | $10^{12.69}$ | $10^{14.23}$ | $1/10^{1.54}$ | water | 1.00 | Within invention |
| 6 | 1.0 | A1 | 35 | 0.5 | Fluoroethyltri-methoxysilane | 0.462 | SUPERCHLON | $10^{13.50}$ | $10^{14.98}$ | $1/10^{1.48}$ | toluene | 1.00 | Within invention |
| 7 | 0.4 | A2 | 80 | 0.5 | Methyltri-methoxysilane | 0.510 | SG2000 | $10^{12.69}$ | $10^{14.23}$ | $1/10^{1.54}$ | | 0.40 | Within invention |
| 8 | 0.5 | A2 | 80 | 0.5 | Methyltri-methoxysilane | 0.510 | SG2000 | $10^{12.69}$ | $10^{14.23}$ | $1/10^{1.54}$ | *3 | 0.30 | Within invention |

TABLE 5-continued

| Photo-receptor | Surface Roughness of Aluminum Substrate | Interlayer: Titanium Oxide Pigment | | | | | Interlayer: Binder | | | | | | | |
|---|---|---|---|---|---|---|---|---|---|---|---|---|---|---|
| | | Type | Particle Diameter | Content of niobium element | Surface Treatment | Si/Ti | Resin | Binder Volume Resistivity (Ωcm) A | B | A/B | Solvent | Dry Film Thickness | Remark |
| No. | Rz (μm) | | (nm) | (% by mass) | | | | | | | | (μm) | |
| 9 | 0.5 | A2 | 80 | 0.5 | Methyltri-methoxysilane | 0.510 | SG2000 | $10^{12.69}$ | $10^{14.23}$ | $1/10^{1.54}$ | water | 0.40 | Within invention |
| 10 | 0.5 | A2 | 80 | 0.5 | Methyltri-methoxysilane | 0.510 | SG2000 | $10^{12.69}$ | $10^{14.23}$ | $1/10^{1.54}$ | water | 1.00 | Within invention |
| 11 | 0.5 | A2 | 80 | 0.5 | Methyltri-methoxysilane | 0.510 | SG2000 | $10^{12.69}$ | $10^{14.23}$ | $1/10^{1.54}$ | water | 1.50 | Within invention |
| 12 | 1.0 | A3 | 65 | 0.5 | Octyltri-methoxysilane | 0.113 | X1010 | $10^{14.85}$ | $10^{15.26}$ | $1/10^{0.41}$ | *1 | 1.00 | Within invention |

*1: ethanol/n-propyl alcohol (6/1)
*2: toluene/ethyl acetate (1/4)
*3: isopropyl alcohol

TABLE 6

| Photo-receptor | Surface Roughness of Aluminum Substrate | Interlayer: Titanium Oxide Pigment | | | | | Interlayer: Binder | | | | | | | |
|---|---|---|---|---|---|---|---|---|---|---|---|---|---|---|
| | | Type | Particle Diameter | Content of niobium element | Surface Treatment | Si/Ti | Resin | Binder Volume Resistivity (Ωcm) A | B | A/B | Solvent | Dry Film Thickness | Remark |
| No. | Rz (μm) | | (nm) | (% by mass) | | | | | | | | (μm) | |
| 13 | 1.0 | A3 | 65 | 0.5 | Octyltrimeth-oxysilane | 0.113 | X1010 | $10^{14.85}$ | $10^{15.26}$ | $1/10^{0.41}$ | *1 | 2.00 | Within invention |
| 14 | 2.5 | A4 | 40 | 0.5 | Methyltrimeth-oxysilane | 0.340 | NL2532 | $10^{14.64}$ | $10^{15.18}$ | $1/10^{0.54}$ | *2 | 1.75 | within invention |
| 15 | 2.5 | A4 | 40 | 0.5 | Methyltrimeth-oxysilane | 0.340 | NL2532 | $10^{14.64}$ | $10^{15.18}$ | $1/10^{0.54}$ | *2 | 2.50 | Within invention |
| 16 | 2.5 | A4 | 40 | 0.5 | Methyltrimeth-oxysilane | 0.340 | NL2532 | $10^{14.64}$ | $10^{15.18}$ | $1/10^{0.54}$ | *2 | 5.00 | Within invention |
| 17 | 2.5 | A4 | 40 | 0.5 | Methyltrimeth-oxysilane | 0.340 | NL2532 | $10^{14.64}$ | $10^{15.18}$ | $1/10^{0.54}$ | *2 | 10.00 | Within invention |
| 18 | 2.5 | A4 | 40 | 0.5 | Methyltrimeth-oxysilane | 0.340 | NL2532 | $10^{14.64}$ | $10^{15.18}$ | $1/10^{0.54}$ | *2 | 20.00 | Within invention |
| 19 | 3.0 | A4 | 40 | 0.5 | Methyltrimeth-oxysilane | 0.340 | NL2532 | $10^{14.64}$ | $10^{15.18}$ | $1/10^{0.54}$ | *2 | 3.0 | Within invention |
| 20 | 1.0 | A5 | 15 | 300 ppm | Methylhydrogen-polysiloxane | 0.020 | NL2532 | $10^{14.64}$ | $10^{15.18}$ | $1/10^{0.54}$ | *2 | 1.00 | Within invention |
| 21 | 1.0 | A6 | 180 | 1.8 | Methyltrimeth-oxysilane | 0.340 | NL2532 | $10^{14.64}$ | $10^{15.18}$ | $1/10^{0.54}$ | *2 | 1.00 | Within invention |
| 22 | 1.0 | A7 | 35 | 0.5 | Methyltrimeth-oxysilane | 0.010 | SG2000 | $10^{12.69}$ | $10^{14.23}$ | $1/10^{1.54}$ | water | 0.50 | Without invention |
| 23 | 1.0 | A8 | 35 | 0.5 | Methyltrimeth-oxysilane | 0.565 | NL2532 | $10^{14.64}$ | $10^{15.18}$ | $1/10^{0.54}$ | *2 | 5.00 | Without invention |

*1: ethanol/n-propyl alcohol (6/1)
*2: toluene/ethyl acetate (1/4)

In the Table above, the name of the binder resin is described as the first embodiment. The method of defining the film thickness of the interlayer and measuring the volume resistivity, and the film thickness meter or the like are the same as the first embodiment.

Evaluation

The evaluation was carried out as well as the first embodiment.

Evaluation Items and Evaluation Criteria

Image Density: (The measurement was performed using RD-918 manufactured by Macbeth Co., Ltd. Assuming that reflection density of paper was set at "0", the image density was measured by the relative reflection density. As the residual potential more increases due to a number of copies, the image density more decreases. The measurement was carried out at the solid black image portion after 10,000 copies were each taken.)

⊚: Solid black image density was more than 1.2 (Good).

○: Solid black image density was from 1.0 to 1.2 (practically unproblematic)

X: Solid black image density was less than 1.0 (practically problematic)

Fog

The fog density was measured in such a manner that the density of solid white images was determined by the reflection density, using RD-918 manufactured by Macbeth Co., Ltd. The reflection density was evaluated by the relative density (assuming that the density of A4 size paper not copied was set at 0.000).

◎: Density was less than 0.010 (Good).

○: Density was from 0.010 to 0.020 (practically unproblematic).

X: Density was more than 0.020 (practically problematic).

Evaluation for black spots, moiré, and the sharpness of the images was carried out on the same criteria as Embodiment 1.

remarkable improvement effects are found in the photoreceptors 1 to 6, 12, 13, and 15 to 17 that the surface roughness Rz of the aluminum substrate is in the range of from 0.5 to 2.5 μm, the anatase-type titanium oxide in the interlayer contains a silicon atom in the range of from 0.10 to 0.50 in terms of (Si/M) ratio and the film thickness T is from Rz to 10 μm.

Embodiment 3

The present invention is described in detail below by referring to other examples.

The photoreceptor 1 was prepared as well as the first embodiment except the following interlayer dispersion liquid was used.

TABLE 7

| | Electrophotographic Property Evaluation | | | | | | Image Evaluation Sharpness | | | | | |
|---|---|---|---|---|---|---|---|---|---|---|---|---|
| Photoreceptor No. | VHH (−V) | VHL (−V) | \|ΔVH\| (V) | VLH (−V) | VLL (−V) | \|ΔVL\| (V) | Image Density | Fog | Black Spot | Moire | Sharpness | Remark |
| 1 | 745 | 55 | 690 | 755 | 105 | 650 | ◎ | ◎ | ◎ | ◎ | ◎ | within invention |
| 2 | 745 | 60 | 685 | 750 | 110 | 640 | ◎ | ◎ | ◎ | ◎ | ◎ | within invention |
| 3 | 745 | 60 | 685 | 750 | 110 | 640 | ◎ | ◎ | ◎ | ◎ | ◎ | within invention |
| 4 | 745 | 70 | 675 | 760 | 120 | 640 | ◎ | ◎ | ◎ | ◎ | ◎ | within invention |
| 5 | 745 | 60 | 685 | 755 | 110 | 645 | ◎ | ◎ | ◎ | ◎ | ◎ | within invention |
| 6 | 745 | 70 | 675 | 754 | 120 | 634 | ◎ | ◎ | ◎ | ◎ | ◎ | within invention |
| 7 | 735 | 80 | 655 | 740 | 130 | 610 | ◎ | ◎ | ○ | ○ | ○ | within invention |
| 8 | 735 | 85 | 650 | 745 | 135 | 610 | ◎ | ◎ | ○ | ○ | ○ | within invention |
| 9 | 735 | 75 | 660 | 745 | 125 | 620 | ◎ | ◎ | ○ | ◎ | ○ | within invention |
| 10 | 750 | 60 | 690 | 750 | 110 | 640 | ◎ | ◎ | ○ | ◎ | ◎ | within invention |
| 11 | 750 | 70 | 680 | 750 | 120 | 630 | ◎ | ◎ | ○ | ◎ | ◎ | within invention |
| 12 | 750 | 65 | 685 | 750 | 115 | 635 | ◎ | ◎ | ◎ | ◎ | ◎ | within invention |
| 13 | 750 | 75 | 675 | 750 | 125 | 625 | ◎ | ◎ | ◎ | ◎ | ◎ | within invention |
| 14 | 750 | 120 | 630 | 750 | 160 | 590 | ◎ | ◎ | ○ | ◎ | ○ | within invention |
| 15 | 750 | 60 | 690 | 765 | 110 | 655 | ◎ | ◎ | ◎ | ◎ | ◎ | within invention |
| 16 | 740 | 55 | 685 | 770 | 120 | 650 | ◎ | ◎ | ◎ | ◎ | ◎ | within invention |
| 17 | 750 | 70 | 680 | 770 | 130 | 640 | ◎ | ◎ | ◎ | ◎ | ◎ | within invention |
| 18 | 760 | 130 | 630 | 770 | 170 | 600 | ○ | ○ | ◎ | ◎ | ○ | within invention |
| 19 | 750 | 125 | 625 | 760 | 165 | 595 | ◎ | ◎ | ○ | ○ | ○ | within invention |
| 20 | 700 | 130 | 570 | 720 | 160 | 560 | ○ | ○ | ○ | ◎ | ○ | within invention |
| 21 | 750 | 160 | 590 | 750 | 180 | 570 | ○ | ○ | ○ | ◎ | ○ | within invention |
| 22 | 660 | 140 | 520 | 720 | 240 | 480 | ○ | X | X | ○ | X | without invention |
| 23 | 720 | 160 | 560 | 740 | 200 | 540 | X | ○ | ○ | ◎ | X | Without invention |

As is apparent from Table 7, as compared with the photoreceptor 22 having an interlayer comprising an anatase-type titanium oxide containing a silicon atom only in an amount of 0.010 in terms of (Si/M) ratio or the photoreceptor 23 having an interlayer comprising an anatase-type titanium oxide containing a silicon atom in an amount of 0.565 in terms of (Si/M) ratio, the photoreceptors 1 to 21 of the present invention having an interlayer comprising an anatase-type titanium oxide containing a silicon atom in an amount of from 0.02 to 0.55 in terms of (Si/M) ratio are excellent in stability of charging potential and sensitivity under the environmental conditions of high temperature and high humidity, and low temperature and low humidity and therefore, improvement effects on image density, fog, black spot, moiré, etc. are remarkable, as a result, an electrophotographic image having excellent sharpness is obtained. On the other hand, the photoreceptor 22 is large in the potential decrease of unexposed portion potentials VHH and VLH and therefore, black spots and fog are formed, as a result, the sharpness of the image is reduced. Further, the photoreceptor 23 is high in the exposed portion potentials VHL and VLL and therefore, the image density is decreased, as a result, the sharpness of the image is reduced. In addition, among the photoreceptors 1 to 21 of the present invention, particularly (Preparation of Interlayer Dispersion Liquid)

Binder resin: (Exemplified polyamide N-1) 1 part

Anatase-type titanium oxide A1 containing a niobium element in an amount of 0.5% by mass (primary particle diameter: 35 nm, surface treatment: treatment by fluoroethyltrimethoxysilane) 3.0 parts Isopropyl alcohol 10 parts The above-described components were mixed and dispersed by a batch method for 10 hours using a sand mill disperser. Thus, an interlayer dispersion liquid was prepared.

Preparation of Photoreceptors 2 to 23

Photoreceptors 2 to 23 were prepared in the same manner as in Photoreceptor 1 except that compositions of surface roughness Rz of aluminum substrate, particle of interlayer, binder resin, dry film thickness, etc. were changed as shown in Tables 8 and 9.

In Tables, A1 to A6 are as well as the Embodiment 1.

Further, the measurements of fusion heat and water absorption coefficient in Tables 8 and 9 were performed as follows.

Measurement Conditions of Fusion Heat

Measuring device: Measurement was performed by use of a "differential scanning calorimeter DSC-50" produced by Shimadzu Seisakusho Co., Ltd.

Measurement conditions: The sample to be measured was installed in the measuring device above and then, the measurement was started from a room temperature (24° C.). The temperature was raised to 200° C. at a temperature rising rate of 5° C./min and then cooled to the room temperature at a temperature lowering rate of 5° C./min. This operation was continuously carried out twice and the fusion heat was calculated from a heat-absorption peak area due to the fusion at the second temperature rising.

Measurement Conditions of Water Absorption Coefficient

The sample to be measured was sufficiently dried for 3 to 4 hours at 70 to 80° C. and then, the mass thereof was precisely weighed. Next, the sample was put in ion exchanged water at 20° C. and pulled up after passing a given length of time. Then, water on the surface of the sample was wiped out with a clean cloth to measure the mass. The operation described above was repeated till increase of the mass was saturated. The increased mass (increased portion) of the resultant sample was divided by the initial mass. The value obtained was designated as a water absorption coefficient.

TABLE 8

| | | Interlayer | | | | | | | | | |
|---|---|---|---|---|---|---|---|---|---|---|---|
| | | | | | Binder Resin | | | | | | |
| Photo-receptor No. | Surface Roughness of Aluminum Substrate Rz (μm) | Part-icle | Particle Diameter (nm) | Surface Treatment | Type | Fusion Heat (J/g) | Water Absorption Coefficient (% by mass) | Ratio of Unit Structure Having 7 or more Carbon Atoms (% by mol) | Solvent | Dry Film Thick-ness (μm) | Remark |
| 1 | 1.0 | A1 | 35 | Fluoroethyltri-methoxysilane | N-1 | 0 | 1.9 | 100 | isopropyl alcohol | 1.00 | within invention |
| 2 | 1.0 | A1 | 35 | Fluoroethyltri-methoxysilane | N-2 | 0 | 2.0 | 100 | isopropyl alcohol | 1.00 | within invention |
| 3 | 1.0 | A1 | 35 | Fluoroethyltri-methoxysilane | N-3 | 0 | 2.8 | 45 | isopropyl alcohol | 1.00 | within invention |
| 4 | 1.0 | A1 | 35 | Fluoroethyltri-methoxysilane | N-6 | 12 | 3.4 | 65 | isopropyl alcohol/ butanol (6/1) | 1.00 | within invention |
| 5 | 1.0 | A1 | 35 | Fluoroethyltri-methoxysilane | N-7 | 28 | 3.8 | 60 | isopropyl alcohol/ butanol (6/1) | 1.00 | within invention |
| 6 | 1.0 | A1 | 35 | Fluoroethyltri-methoxysilane | N-8 | 23 | 4.5 | 45 | ethanol/1-propanol (1/5) | 1.00 | within invention |
| 7 | 0.4 | A2 | 180 | Methylhydrogen-polysiloxane | N-1 | 0 | 1.9 | 100 | isopropyl alcohol | 0.40 | within invention |
| 8 | 0.5 | A2 | 180 | Methylhydrogen-polysiloxane | N-1 | 0 | 1.9 | 100 | isopropyl alcohol | 0.30 | within invention |
| 9 | 0.5 | A2 | 180 | Methylhydrogen-polysiloxane | N-1 | 0 | 1.9 | 100 | isopropyl alcohol | 0.40 | within invention |
| 10 | 0.5 | A2 | 180 | Methylhydrogen-polysiloxane | N-1 | 0 | 1.9 | 100 | isopropyl alcohol | 1.00 | within invention |
| 11 | 0.5 | A2 | 180 | Methylhydrogen-polysiloxane | N-1 | 0 | 1.9 | 100 | isopropyl alcohol | 1.50 | within invention |
| 12 | 1.0 | A3 | 65 | Octyltrimeth-oxysilane | N-2 | 0 | 2.0 | 100 | isopropyl alcohol | 1.00 | within invention |

TABLE 9

| Photo-recep-tor No. | Surface Roughness of Aluminum Substrate Rz (μm) | Interlayer: Part-icle | Particle Diameter (nm) | Surface Treatment | Binder Resin: Type | Fusion Heat (J/g) | Water Absorption Coefficient (% by mass) | Ratio of Unit Structure Having 7 or more Carbon Atoms (% by mol) | Solvent | Dry Film Thick-ness (μm) | Remark |
|---|---|---|---|---|---|---|---|---|---|---|---|
| 13 | 1.0 | A3 | 65 | Octyltrimeth-oxysilane | N-2 | 0 | 2.0 | 100 | isopropyl alcohol | 2.00 | within invention |
| 14 | 2.5 | A4 | 15 | Fluoroethyltri-methoxysilane | N-3 | 0 | 2.8 | 45 | isopropyl alcohol | 1.75 | within invention |
| 15 | 2.5 | A4 | 15 | Fluoroethyltri-methoxysilane | N-3 | 0 | 2.8 | 45 | isopropyl alcohol | 2.50 | within invention |
| 16 | 2.5 | A4 | 15 | Fluoroethyltri-methoxysilane | N-3 | 0 | 2.8 | 45 | isopropyl alcohol | 5.00 | within invention |
| 17 | 2.5 | A4 | 15 | Fluoroethyltri-methoxysilane | N-3 | 0 | 2.8 | 45 | isopropyl alcohol | 10.00 | within invention |
| 18 | 2.5 | A4 | 15 | silica · alumina | N-3 | 0 | 2.8 | 45 | isopropyl alcohol | 20.00 | within invention |
| 19 | 3.0 | A4 | 15 | Fluoroethyltri-methoxysilane | N-3 | 0 | 2.8 | 45 | isopropyl alcohol | 3.0 | within invention |
| 22 | 0.5 | A5 | 35 | Methylhydrogen-polysiloxane | N-2 | 0 | 2.0 | 100 | isopropyl alcohol | 0.50 | without invention |
| 23 | 2.5 | A6 | 35 | Methylhydrogen-polysiloxane | N-2 | 0 | 2.0 | 100 | isopropyl alcohol | 5.00 | without invention |

In Tables, the ratio of a unit structure having 7 or more carbon atoms represents a ratio (% by mol) of a repeating unit structure having 7 or more carbon atoms between the amide bonds in the repeating unit structure. Further, N-12 represents a methoxymethylated nylon 6 (the number of carbon atoms between amide bonds is 5 and methoxymethylation degree is 25%) and N-13 represents a polyamide having the following structure.

N-13

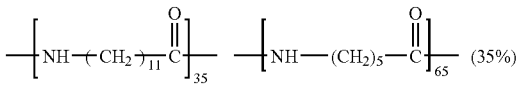

"%" in the parentheses in the N-13 structure represents a ratio (% by mol) of a repeating unit structure having 7 or more carbon atoms between the amide bonds in the repeating unit structure.

Evaluation

The evaluation was carried out as well as the first embodiment. The evaluation results are shown in Table 10.

TABLE 10

| Photoreceptor No. | Potential Evaluation: VHH(−V) | VHL(−V) | \|ΔVH\| (V) | VLH(−V) | VLL(−V) | \|ΔVL\| (V) | Image Evaluation: Image Density | Fog | Black Spot | Moire | Sharpness | Remark |
|---|---|---|---|---|---|---|---|---|---|---|---|---|
| 1 | 740 | 52 | 688 | 760 | 120 | 640 | ◎ | ◎ | ◎ | ◎ | ◎ | within invention |
| 2 | 740 | 56 | 684 | 750 | 116 | 634 | ◎ | ◎ | ◎ | ◎ | ◎ | within invention |
| 3 | 740 | 60 | 680 | 750 | 120 | 630 | ◎ | ◎ | ◎ | ◎ | ◎ | within invention |
| 4 | 740 | 100 | 640 | 760 | 140 | 620 | ◎ | ◎ | ○ | ◎ | ○ | within invention |
| 5 | 740 | 120 | 620 | 750 | 150 | 600 | ◎ | ◎ | ○ | ◎ | ○ | within invention |
| 6 | 730 | 120 | 610 | 754 | 154 | 600 | ◎ | ◎ | ○ | ◎ | ○ | within invention |
| 7 | 740 | 80 | 660 | 742 | 122 | 620 | ◎ | ◎ | ○ | ○ | ○ | within invention |
| 8 | 740 | 85 | 655 | 746 | 126 | 620 | ◎ | ◎ | ○ | ○ | ○ | within invention |
| 9 | 740 | 70 | 670 | 746 | 130 | 610 | ◎ | ◎ | ○ | ◎ | ○ | within invention |
| 10 | 740 | 55 | 685 | 750 | 110 | 640 | ◎ | ◎ | ◎ | ◎ | ◎ | within invention |
| 11 | 746 | 56 | 690 | 760 | 115 | 645 | ◎ | ◎ | ◎ | ◎ | ◎ | within invention |
| 12 | 740 | 60 | 680 | 750 | 110 | 640 | ◎ | ◎ | ◎ | ◎ | ◎ | within invention |
| 13 | 748 | 60 | 688 | 760 | 120 | 640 | ◎ | ◎ | ◎ | ◎ | ◎ | within invention |
| 14 | 748 | 100 | 648 | 754 | 140 | 614 | ◎ | ◎ | ○ | ◎ | ○ | within invention |
| 15 | 750 | 60 | 690 | 770 | 130 | 640 | ◎ | ◎ | ◎ | ◎ | ◎ | within invention |
| 16 | 756 | 65 | 691 | 770 | 135 | 635 | ◎ | ◎ | ◎ | ◎ | ◎ | within invention |

TABLE 10-continued

| | Potential Evaluation | | | | | | Image Evaluation | | | | | |
|---|---|---|---|---|---|---|---|---|---|---|---|---|
| Photoreceptor No. | VHH(−V) | VHL(−V) | \|ΔVH\| (V) | VLH(−V) | VLL(−V) | \|ΔVL\| (V) | Image Density | Fog | Black Spot | Moire | Sharpness | Remark |
| 17 | 756 | 70 | 686 | 765 | 135 | 630 | ◎ | ◎ | ◎ | ◎ | ◎ | within invention |
| 18 | 760 | 130 | 630 | 770 | 160 | 610 | ○ | ○ | ◎ | ◎ | ○ | within invention |
| 19 | 748 | 120 | 628 | 760 | 150 | 610 | ◎ | ◎ | ○ | ○ | ○ | within invention |
| 22 | 670 | 120 | 550 | 730 | 250 | 480 | X | X | ○ | ○ | X | without invention |
| 23 | 730 | 160 | 570 | 725 | 160 | 565 | ○ | ○ | X | ◎ | X | without invention |

As is apparent from Table 10, without the scope of the present invention, the photoreceptors 1 to 19 of the present invention having an interlayer comprising a resin having fusion heat of 0 to 40 J/g and a water absorption coefficient of 5% by mass or less, and an anatase-type titanium oxide pigment containing a niobium element in an amount of from 100 ppm to 2.0% by mass have excellent stability of unexpoed portion potential and exposed portion potential under the environmental conditions of high temperature and high humidity, and low temperature and low humidity, have fully potential differences |ΔVH| and |ΔVL| and therefore, image density is sufficient, fog density is reduced and improvement effects on black spots, etc. are noticeable, as a result, an electrophotographic image having excellent sharpness is obtained. Particularly, noticeable improvement effects are found on the photoreceptors 1 to 3, 10 to 13 and 15 to 17 that the surface roughness Rz of the electroconductive support is from 0.5 to 2.5 μm, the water content of the interlayer resin is 3% by mass or less and the film thickness is from Rz to 10 μm. On the other hand, the photoreceptor 22 using an anatase-type titanium oxide pigment containing a niobium element in an amount of 70 ppm is large in decrease of an unexposed portion potential VHH and in increase of an exposed portion potential VLL and therefore, decrease in image density and formation of fog are caused, as a result, the image sharpness is also reduced. Further, the photoreceptor 23 using an anatase-type titanium oxide pigment containing a niobium element in an amount of 2.2% by mass is noticeable in the occurrence of black spots, as a result, the image sharpness is also reduced.

Among the photoreceptors 1 to 19 of the present invention, noticeable improvement effects are found, particularly on the photoreceptors 1 to 3, 10 to 13 and 15 to 17 that the surface roughness Rz of an aluminum substrate is from 0.5 to 2.5 μm, the interlayer resin has fusion heat of from 0 to 30 J/g and a water absorption coefficient of 3% by mass or less and the film thickness T is from Rz to 10 μm.

What is claimed is:

1. An electrophotographic photoreceptor having an interlayer and a photosensitive layer on an electroconductive substrate, wherein the interlayer comprises an N-type semiconductive particle comprising one or more transition metals having an atomic number of 21 to 30, 39, 41 to 48 and 57 to 80, a total amount of the transition metals having an atomic number of 21 to 30, 39, 41 to 48 and 57 to 80 being from 100 ppm to 2.0% by mass.

2. The electrophotographic photoreceptor of claim 1, wherein the N-type semiconductive particle comprises an anatase-type titanium oxide pigment.

3. The electrophotographic photoreceptor of claim 2, wherein an anatase degree of the anatase-type titanium oxide pigment is from 90 to 100%.

4. The electrophotographic photoreceptor of claim 3, wherein the transition metal is a niobium element having an atomic number of 41.

5. The electrophotographic photoreceptor of claim 1, wherein the N-type semiconductive particle contains a metal oxide selected from titanium oxide, zinc oxide and tin oxide.

6. The electrophotographic photoreceptor of claim 1, wherein the N-type semiconductive particle comprises one or more of the transition metals having an atomic number of 21 to 30, 39 and 41 to 48.

7. The electrophotographic photoreceptor of claim 1, wherein the one or more transition metals is a niobium element having an atomic number of 41.

8. The electrophotographic photoreceptor of claim 1, wherein a surface roughness Rz of the electroconductive substrate is from 0.5 to 2.5 μm.

9. The electrophotographic photoreceptor of claim 1, wherein the N-type semiconductive particle is surface-treated by a reactive organic silicon compound.

10. The electrophotographic photoreceptor of claim 1, comprising a plurality of the N-type semiconductive particle having a number average primary particle diameter of from 10 nm to 200 nm.

11. The electrophotographic photoreceptor of claim 1, wherein a film thickness T of the interlayer has a relation represented by the following Formula (1) with the surface roughness Rz:

$$0.7Rz \leqq T \leqq 20\ (\mu m) \qquad \text{Formula (1).}$$

12. The electrophotographic photoreceptor of claim 1, wherein the interlayer contains a resin having fusion heat of from 0 to 40 J/g.

13. The electrophotographic photoreceptor of claim 12, wherein the interlayer contains a resin having a water absorption coefficient of 5% by mass or less.

14. The electrophotographic photoreceptor of claim 13, wherein a surface roughness Rz of the electroconductive substrate is from 0.5 to 2.5 μm.

15. The electrophotographic photoreceptor of claim 13, wherein a film thickness T of the interlayer has a relation represented by the following Formula (1) with the surface roughness Rz:

$$0.7Rz \leqq T \leqq 20\ (\mu m) \qquad \text{Formula (1).}$$

16. The electrophotographic photoreceptor of claim 1, wherein the interlayer contains a resin having a water absorption coefficient of 5% by mass or less.

17. The electrophotographic photoreceptor of claim 16, wherein the resin is an alcohol soluble polyamide.

18. The electrophotographic photoreceptor of claim 17, wherein the resin is a polyamide having a repeating unit structure represented by the following Formula (3):

Formula (3)

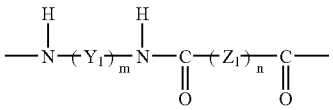

(wherein $Y_1$ represents a group containing a divalent alkyl-substituted cycloalkane, $Z_1$ represents a methylene group, m represents a natural number of 1 to 3 and n represents a natural number of 3 to 20).

19. The electrophotographic photoreceptor of claim 18, wherein the $Y_1$ has the following chemical structure:

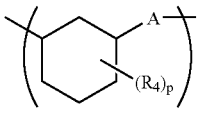

(wherein A represents a single bond or a 14C alkylene group, $R_4$ represents an alkyl group and p represents a natural number of 1 to 5).

20. An apparatus comprising the electrophotographic photoreceptor of claim 1, and at least one of a charging unit for uniformly charging the electrophotographic photoreceptor, a latent image forming unit for forming an electrostatic latent image on the charged electrophotographic photoreceptor, a developing unit for visualizing the electrostatic latent image formed on the electrophotographic photoreceptor, a transferring unit for transferring to a transfer material the toner image visualized on the electrophotographic photoreceptor, a charge removing unit for removing a charge on the electrophotographic photoreceptor after the transfer, and a cleaning unit for removing the residual toner on the electrophotographic photoreceptor after the transfer.

21. The apparatus of claim 20, which comprises an electrophotographic photoreceptor integrally supported with at least one of a charging unit for uniformly charging said electrophotographic photoreceptor, a latent image forming unit for forming an electrostatic latent image on the charged electrophotographic photoreceptor, a developing unit for visualizing the electrostatic latent image on said electrophotographic photoreceptor, a transferring unit for transferring to a transfer material the toner image visualized on said electrophotographic photoreceptor, a charge removing unit for removing a charge on said electrophotographic photoreceptor after the transfer, and a cleaning unit for removing the residual toner on said electrophotographic photoreceptor after the transfer.

22. The apparatus of claim 20, which comprises an electrophotographic photoreceptor, with a charging unit for uniformly charging the electrophotographic photoreceptor, a latent image forming unit for forming an electrostatic latent image on the charged electrophotographic photoreceptor, a developing unit for visualizing the electrostatic latent image formed on the electrophotographic photoreceptor to form a toner image, and a transferring unit for transferring to a transfer material the visualized toner image on said electrophotographic photoreceptor.

23. The apparatus of claim 20, wherein the charging unit is a contact charging system.

24. An electrophotographic photoreceptor having an interlayer and a photosensitive layer on an electroconductive substrate, wherein the interlayer comprises a metal oxide particle comprising a niobium element and a silicon atom in a bond energy spectrum by an X-ray photoelectron spectroscopy at a ratio represented by the following Formula (1):

$$0.02 \leqq Si/M \leqq 0.55 \qquad \text{Formula (1)}$$

Si: a peak intensity of a silicon atom among the bond energy spectrum, and

M: a peak intensity of a metal atom among the bond energy spectrum.

25. The electrophotographic photoreceptor of claim 24, wherein the metal oxide particle comprises titanium oxide and the Formula (1) is represented as follows:

$$0.02 \leqq Si/Ti \leqq 0.55 \qquad \text{Formula (1)}$$

Si: a peak intensity of a silicon atom among the bond energy spectrum, and

Ti: a peak intensity of a metal atom among the bond energy spectrum.

26. The electrophotographic photoreceptor of claim 25, wherein the metal oxide particle comprises anatase-type titanium oxide.

* * * * *